US006966550B2

(12) United States Patent
Marks

(10) Patent No.: US 6,966,550 B2
(45) Date of Patent: Nov. 22, 2005

(54) ONE HAND ACTUATED "C" CLAMP

(75) Inventor: Joel Marks, Sherman Oaks, CA (US)

(73) Assignee: Worktools, Inc., Chatsworth, CA (US)

( * ) Notice: Subject to any disclaimer, the term of this patent is extended or adjusted under 35 U.S.C. 154(b) by 4 days.

(21) Appl. No.: 10/273,262

(22) Filed: Oct. 18, 2002

(65) Prior Publication Data

US 2004/0075205 A1 Apr. 22, 2004

(51) Int. Cl.[7] ..... B25B 7/14
(52) U.S. Cl. ..... 269/6; 81/323; 81/324
(58) Field of Search ..... 269/3, 4, 214, 269/215, 237, 238, 239, 225, 302, 318, 319, 269/320, 323, 324, 424

(56) References Cited

U.S. PATENT DOCUMENTS

| | | | | |
|---|---|---|---|---|
| 1,546,139 A | | 7/1925 | Leveque | |
| 2,112,873 A | * | 4/1938 | Wright | 269/214 |
| 2,726,694 A | | 12/1955 | Saxton | |
| 2,838,973 A | | 6/1958 | Peterson | |
| 3,313,190 A | | 4/1967 | Bothum | |
| 3,608,404 A | | 9/1971 | Sarvie | |
| 4,258,908 A | | 3/1981 | Goff et al. | |
| 5,570,500 A | | 11/1996 | Merkel | |
| 6,212,977 B1 | | 4/2001 | Liou | |
| 6,564,703 B1 | * | 5/2003 | Lin | 269/6 |
| 6,684,465 B1 | | 2/2004 | Jo | |

FOREIGN PATENT DOCUMENTS

| | | |
|---|---|---|
| DE | 69401 | 11/1891 |
| DE | 925217 | 3/1955 |

* cited by examiner

*Primary Examiner*—Robert C. Watson
(74) *Attorney, Agent, or Firm*—Brad I Golstein

(57) ABSTRACT

A compact clamp design includes an upper and a lower arm fitted with gripping pads at respective front ends and hinged together at respective back ends. The rearward positioned hinge enables the clamp to open very wide since the hinge and the gripping pads are relatively very far apart. An operating handle integrated as part of an upper arm. When the clamp is closed there are no protruding members. The clamp is very compact and minimally obtrusive.

24 Claims, 16 Drawing Sheets

ONE HAND ACTUATED "C" CLAMP

FIELD OF THE INVENTION

The present invention relates to holding clamps. More precisely the present invention relates to a quick action "C" clamp.

BACKGROUND OF THE INVENTION

Various types of clamps are known. The common "C" clamp is a simple low cost device. A "C" shaped body includes an elongated screw at one end. The screw is advanced toward the opposite end of the clamp to hold an object between. Another well-known type of clamp is a screw actuated pivoted clamp, or cantilevered clamp. A typical version is shown in U.S. Pat. No. 2,726,694. This design allows a large opening size in a relatively compact form, except that the screw and cantilevered arm protrude greatly from the actual clamping structure. A similar clamp is disclosed in U.S. Pat. No. 4,258,908, except that a quick release screw is included to enable faster size closing action.

A more self-contained shape is shown in the clamp of U.S. Pat. No. 5,570,500. A sliding cam is hammered to move it along a triple pivot arrangement. Two pivoted arms move to squeeze an object. It is a specialty device that has a limited clamping range.

A "Spring Chuck" is shown in U.S. Pat. No. 6,212,977. A plier-like clamp includes pivoting jaw pads and a stepless locking mechanism including a bar and surrounding wedge to bind the bar. The maximum opening size is limited since the pivot or hinge is relatively close to the jaw. A similar design is shown in Exhibit A under the brand name "Quick-Grip Handi-Clamp". The Handi-Clamp uses an arcuate locking bar rather than the straight bar of '977. A related type of locking plier is shown in U.S. Pat. No. 3,313,190. A conventional steel plier includes a stepless locking bar and related wedge at the handle distal end. The locking bar is curved as in the "Handi-Clamp". The opening size is very linited since the hinge is very near to the jaws, as is typical is a plier. In the above plier style clamps there is a clear trade-off between available force and clamping force. More leverage or force leads to less possible opening size.

Another design uses a two stage closing process to enable fast action and high force. U.S. Pat. No. 2,838,973 is an example of this well known design for locking pliers. A high force clamping action follows a high speed closing motion. However since the hinge is very near to the jaw the possible opening size is small.

The prior art all have either limited opening capacity or are not compact in size. Most require two hands to operate. It is desirable to have a clamp that is: compact, one handed, large capacity and have high force.

SUMMARY OF THE INVENTION

The present invention provides many improvements to the function of a clamp. An upper and a lower arm are fitted with gripping pads at their front ends and hinged together at respective back ends. The designations of upper and lower are arbitrary; naturally the clamp may be operated in various positions with respect to gravity or other reference factor. This design contrasts with the typical prior art quick action clamps that use the plier type design. An advantage of the rearward positioned hinge is that the clamp can open very wide since the hinge and the gripping pads are relatively very far apart. The present invention clamp comprises primarily just two arms with an operating handle integrated as part of an upper arm. When the clamp is closed there are no protruding members. The clamp is thus very compact and minimally obtrusive. Such compactness may be compared to a hand that has just a thumb and one opposed finger.

In the preferred embodiment the clamp operates by means of one hand through its full range of motion. Pressing the handle causes the lower arm to move up toward the upper arm. A two-stage action links the handle, through the upper arm, to the lower arm. A first stage includes a fast closing motion and second stage includes a slow clamping motion. The first stage is a high arm speed, low arm leverage action that serves to position the clamp gently about or adjacent to an object. The fast first stage continues until the pad of the lower arm meets an obstruction. The obstruction will be either the object that is being clamped or the opposed upper pad if the clamp is empty. A clutch releases a handle-to-lower arm linkage, corresponding to the first stage, as the handle is urged to press against the obstruction. At a predetermined position of the handle, the second stage clamping action begins. Some handle travel normally occurs between the point that the lower arm meets the obstruction (end of first stage) and the actual clamping action starts (start of second stage). The extent of such transitional travel depends on how far the clamp has closed when it meets the obstruction, less transition for small objects, more for large objects. This is discussed further in the detailed description. The high leverage of the second stage enables tight clamping of the object.

In the first stage the handle pivots between outer positions within the upper arm. The clutch preferably pivots about the same position in the upper arm and is further pivotal relative to the handle. The clutch includes an extension that defines a lower distal end of a handle assembly. This lower distal end presses a suitable engagement point of the lower arm such that a small motion of the handle produces a large motion of the lower arm. This first stage engagement point lies between the handle pivot and the rearward hinge of the respective arms. When the lower arm can move no more, the clutch partially releases so that the handle can continue to move even as the lower arm does not, the handle pivoting in relation to the "stationary" clutch and lower arm. The clutch retains some linking force between the handle and lower arm after clutch release so that the lower arm does not reopen while the handle is in the transitional travel mode approaching the second stage.

The second stage involves high forces and thus relies upon hardened steel linkages. This contrasts with the elements of the low force first stage that may be of plastic material. The handle contains a steel lever with gear teeth at the lower end of the lever. The lever pivots about the same point of the upper arm as the handle. The lower arm contains a gear that can mesh with the teeth of the lever. At the predetermined position of the handle the lever is urged to engage the gear, while the clutch holds the lower arm in position. The geometry of the lever and gear is such that the lever has a high leverage upon the gear. This means that the handle, that includes the lever within, can exert a strong closing force upon the lower arm that contains the gear within. This high leverage mode comprises the second stage. The handle pivots about the upper arm upon a fixed location while the lever can translate or slide slightly within the handle to engage or disengage the lever from the gear.

The dual action of the present invention clamp enables a single stroke of a handle to, first adjust a clamp size, and second to squeeze an object so sized. The operation of the distinct stages is not obvious to a user. The combined closing and clamping action thus feels like a single and unexpectedly efficient process. The long reach of the arms of the clamp allows it to hold large objects using a compact form. The actuating element, in this case the handle, is a minimally protruding member of one of the clamp arms.

In a preferred embodiment the lever is held in a clamped position through a stepless locking mechanism. Thus the lever will not retract even slightly after it is pressed into position. This provides the second stage clamping action with a maximum possible holding force.

BRIEF DESCRIPTION OF THE DRAWINGS

FIG. 6A is a side elevation of the upper arm.

FIG. 6B is the upper arm of FIG. 6A, in partial section.

FIG. 6C is the upper arm of FIG. 6A, view from an opposite side.

FIG. 6D is the upper arm of FIG. 6C, in partial section.

FIG. 6E is a top view of the upper arm.

FIG. 6F is a front view of the upper arm.

FIG. 7A is a top view of the lower arm.

FIG. 7B is side elevation of the lower arm of FIG. 7A.

FIG. 7C is the lower arm of FIG. 7B, in partial section.

FIG. 7D is a bottom view of the lower arm.

FIG. 7E is the lower arm of FIG. 7C, view from an opposite side.

FIG. 8A is a side elevation of the handle, partially in section.

FIG. 8B is an exterior view of the handle of FIG. 8A.

FIG. 8C is a side elevation of the handle of FIG. 8A, partially in section and partially hidden, viewed from an opposite side, with a lever in its respective position.

FIG. 8D is the handle of FIG. 8B viewed from an opposite side.

FIG. 8E is a bottom view of the handle.

FIG. 8F is a front view of the handle.

FIG. 9A is a side elevation of the clutch, with a spring installed.

FIG. 9B is the clutch and spring of FIG. 9A viewed from an opposite side.

FIG. 9C is a bottom view of the clutch of FIG. 9B.

FIG. 11A is a front elevation of the front guide.

FIG. 11B is a side elevation of the front guide.

FIG. 11C is a sectional view of the front guide of FIG. 11B.

FIG. 11D is a rear elevation of the front guide.

FIGS. 14A to 14C are views of a release member.

FIG. 14A is a front elevation of the release member.

FIG. 14B is a side elevation of the release member.

FIG. 14C is a bottom view of the release member

FIG. 22A is a front elevation of the release member.

FIG. 22B is a side elevation of the release member.

FIG. 22C is a bottom view of the release member.

DETAILED DESCRIPTION OF THE INVENTION

Figure 1:
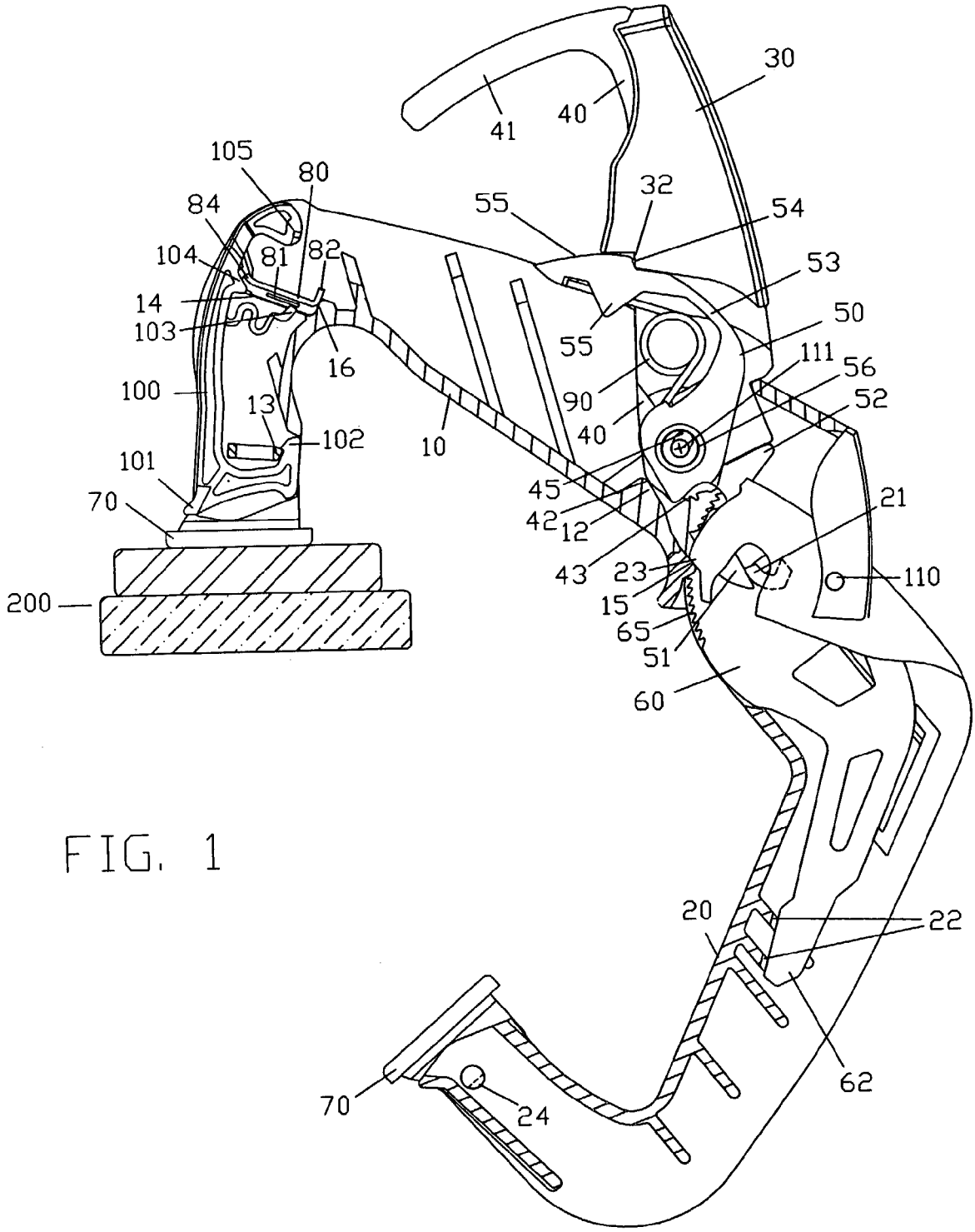
FIG. 1 is a side elevation of a clamp of the invention, in partial cut-away sectional view, with the lower arm and handle in a fully open position.
Figure 2:
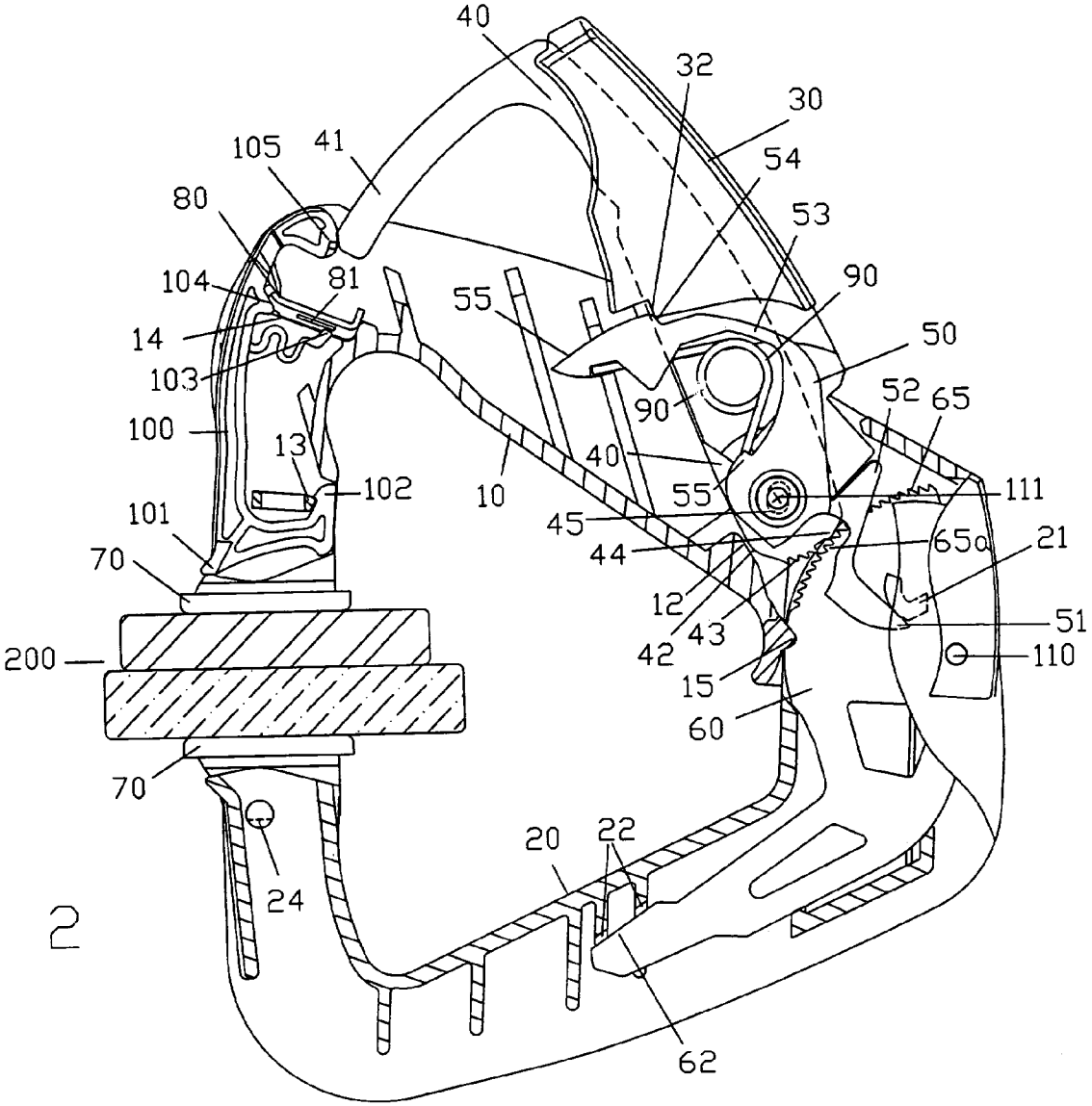
FIG. 2 is the clamp of FIG. 1, in a position just beginning the second stage clamping action.
Figure 3:
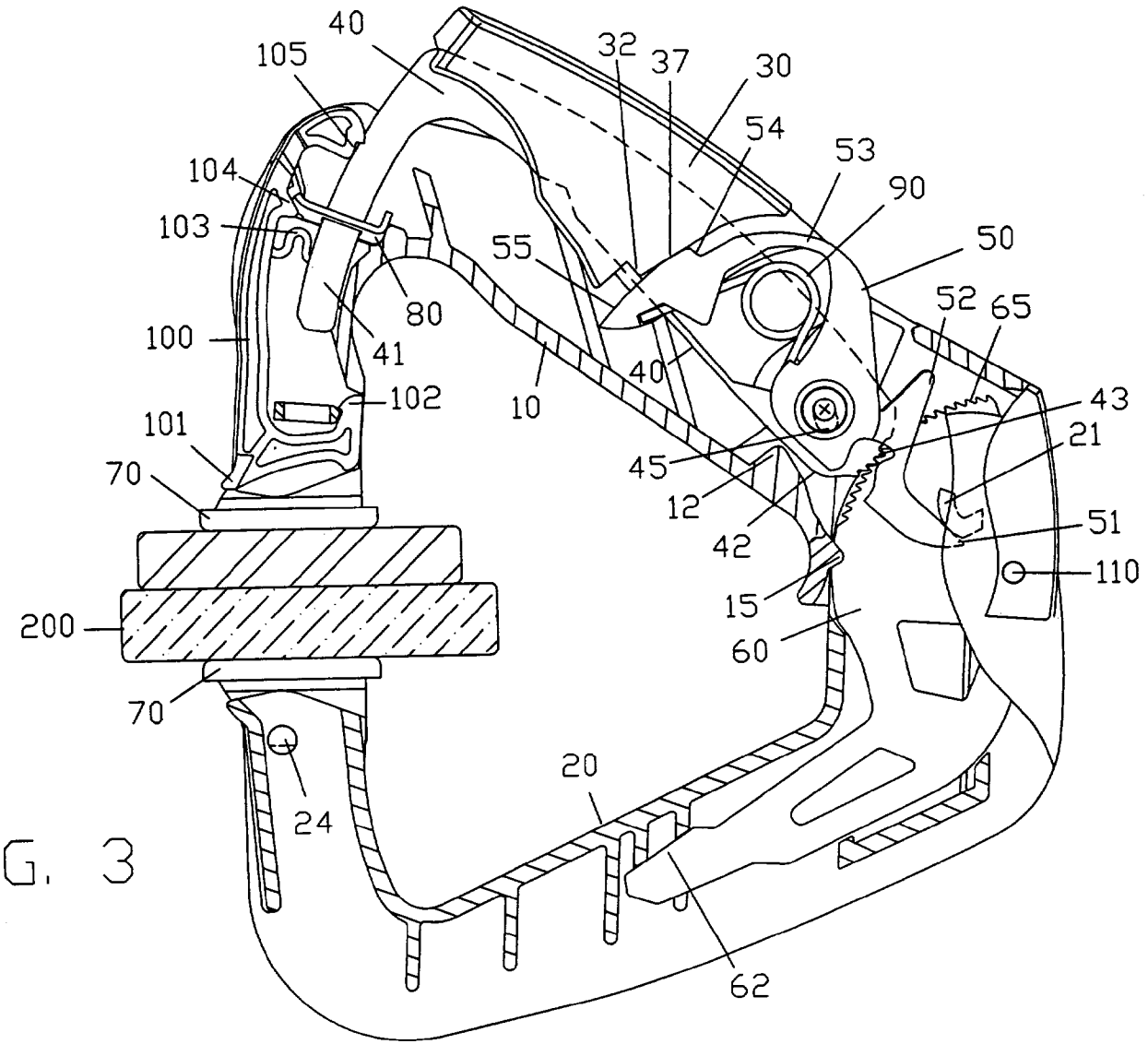
FIG. 3 is the clamp of FIG. 2, in a fully tightened position.
Figure 5:
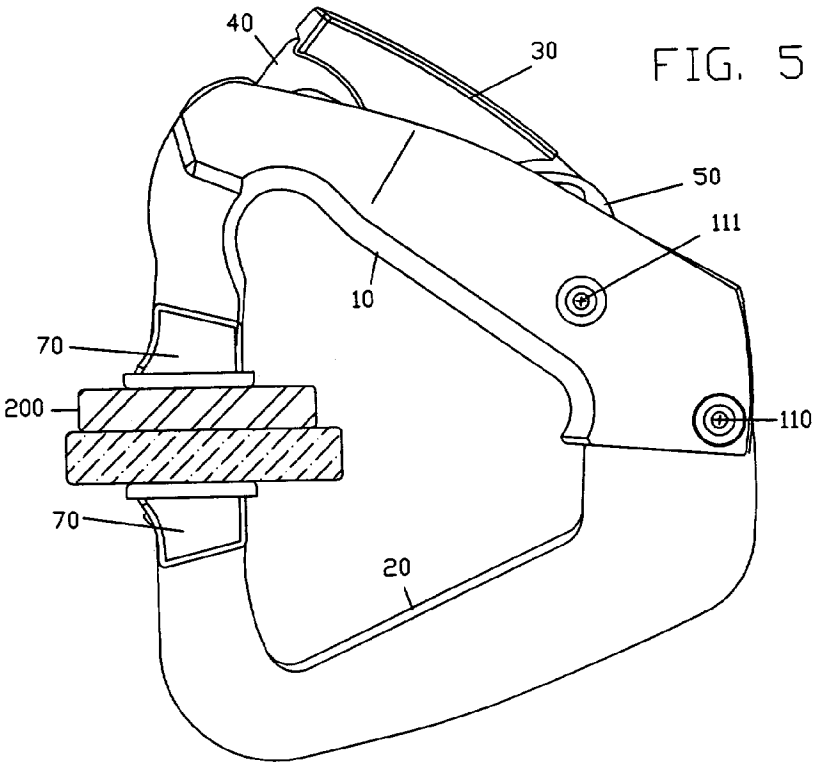
FIG. 5 is an exterior view of the clamp of FIG. 3.
Figure 4:
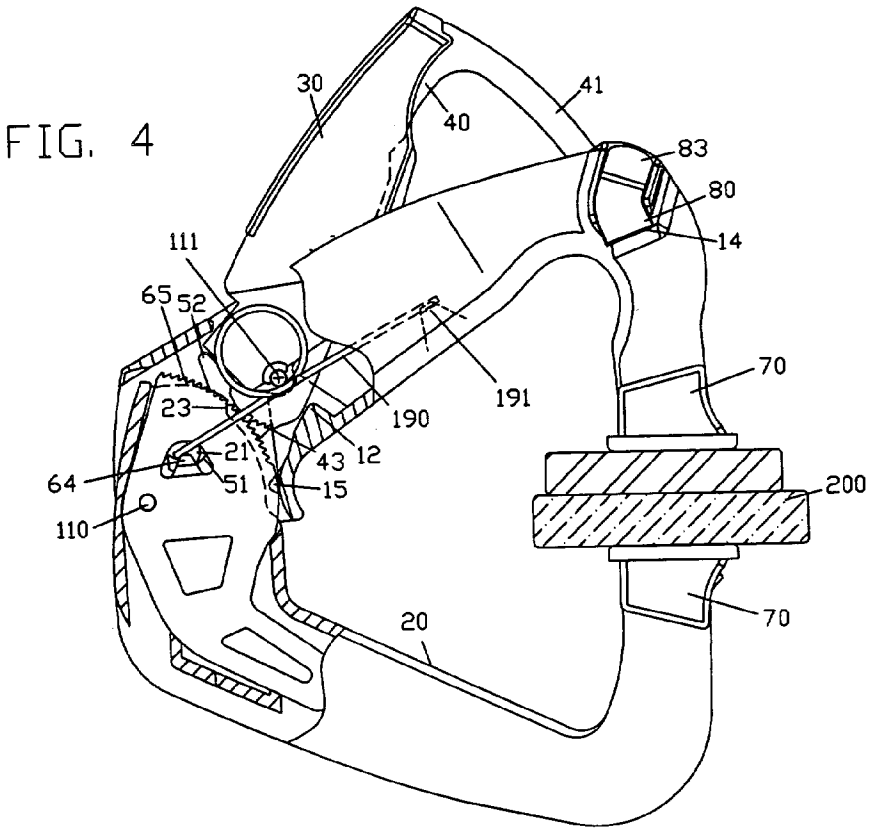
FIG. 4 is a cut-away partial sectional view of the clamp of FIG. 2, viewed from an opposite side.

FIGS. 1 to 3 show the primary components and operating principles of the clamp of the present invention. The clamp is being used to hold two blocks 200 together in the exemplary Figures. In FIG. 1 the clamp is fully open. Handle 30 is in its uppermost rotational position, while lower arm 20 is rotated to its lowermost position. Handle 30 rotates about dowel 111 that is fitted into hole 11A of upper arm 10. See dowel 111 also in FIG. 5. Clutch 50 is engaged in FIG. 1, wherein cam 54 of clutch 50 rests upon ledge 32 of handle 30. Hole 56 of clutch 50 fits about post 36, FIG. 8D, of handle 30. See also FIGS. 8 and 9. Clutch 50 can therefore rotate about post 36. Spring 90 provides a bias within clutch 50 tending to spread the clutch to hold cam 54 in engagement. If clutch 50 is made of a suitably resilient material then flexible segment 53 could provide the bias without the assistance of spring 90. Clutch distal end 51, visible in cut-away in FIG. 1, hidden view in FIGS. 2 and 3, presses cam 21 of lower arm 20. In the fully open position of FIG. 1 stop 15 of upper arm 10 limits the motion of lower arm 20 at stop 23. Stop 23 is visible in FIGS. 1 and 4, but is cut away in FIGS. 2 and 3. Stop 23 defines the most open possible position of the clamp, limiting factors including the size of the section of gear 60 that includes an arcuate array of teeth 65, and maintenance of a reasonable distance between grip pads 70 and hinge dowel 110, or "throat" distance.

Figure 6:
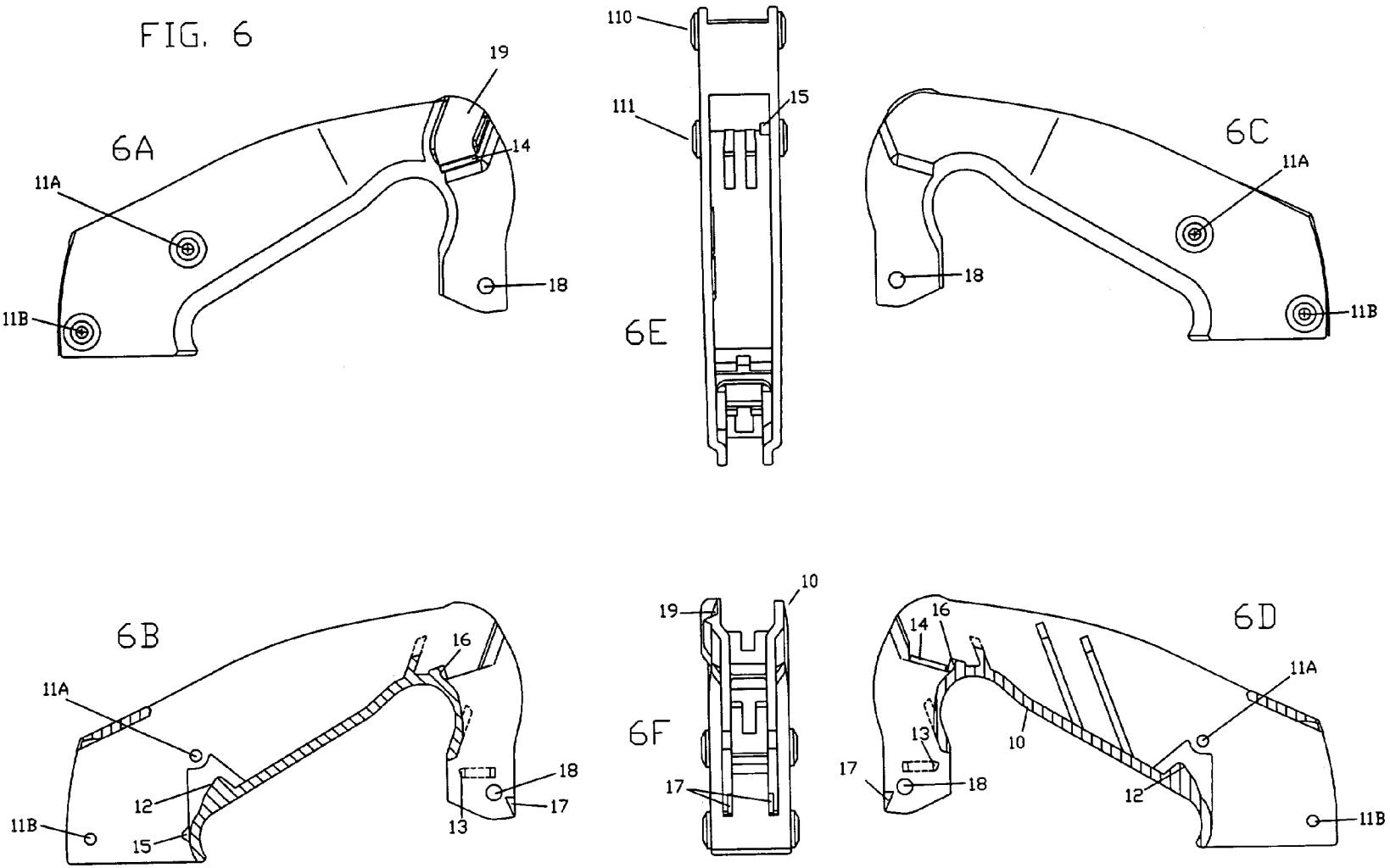
FIGS. 6A to 6F are views of an upper arm.
Figure 7:
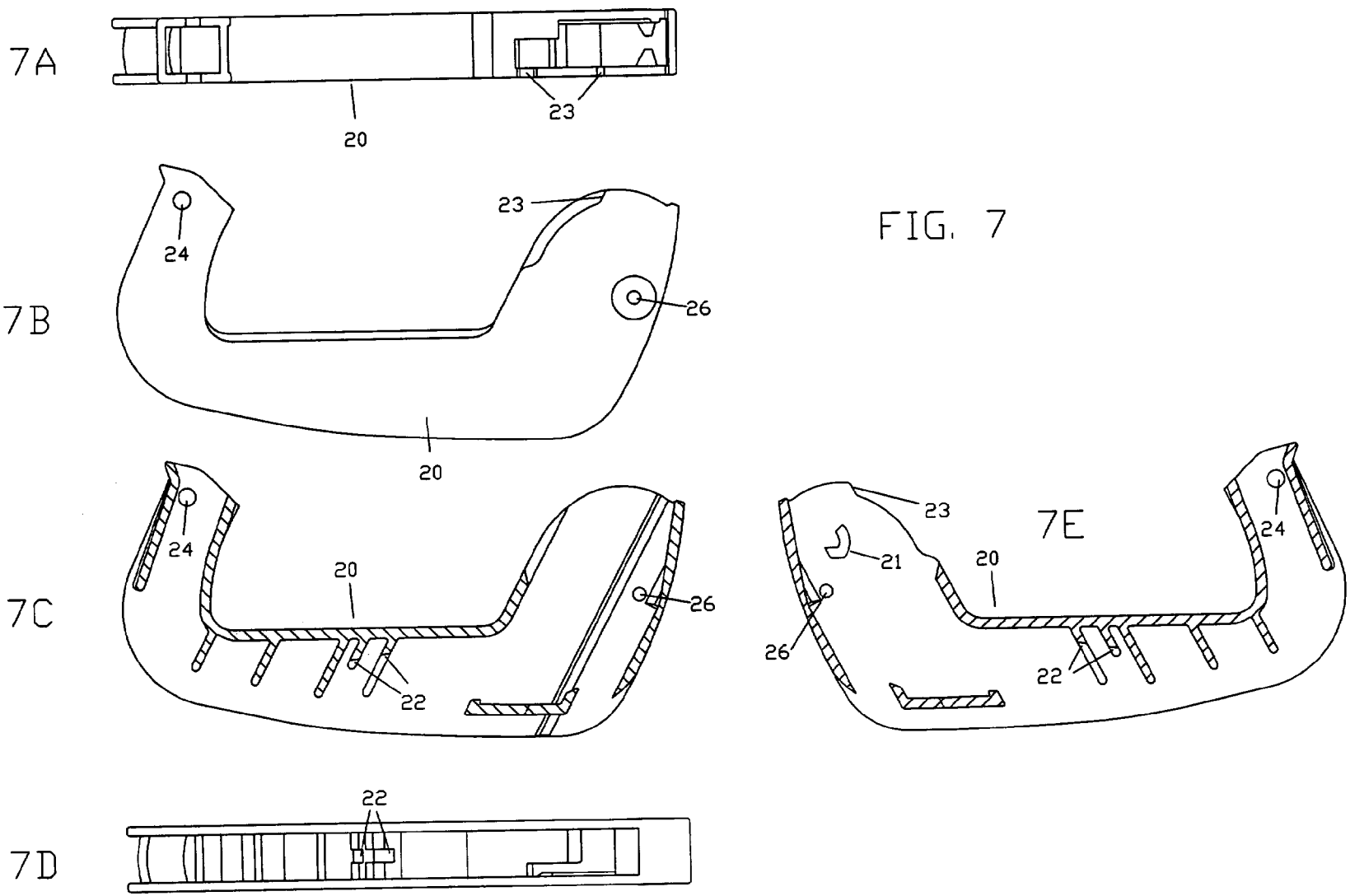
FIGS. 7A to 7E are views of a lower arm.

FIG. 1 represents the start of the first stage of clamping. In this stage lower arm 20 will be moved up to contact blocks 200, FIG. 2. Pressing handle 30 downward causes the handle, and clutch 50, to rotate about dowel 111. Clutch distal end 51 presses upward on cam 21 of the lower arm, causing the lower arm to rotate toward the upper arm about hinge dowel 110. Dowel 110 fits through hole 11B, FIG. 6, of upper arm 10, and hole 26 of lower arm 20, FIG. 7. When grip pads 70 are positioned about blocks 200, FIG. 2, lower arm 20 can move no more. If handle 30 is forcibly moved further, clutch 50 will remain largely stationary within upper arm 10, since the obstruction created by blocks 200 prevents the lower arm and thus cam 21 from moving any further.

Clutch 50 will then release whereby cam 54 slides out of contact with ledge 32. In FIG. 2 this sliding disengagement is just beginning. If blocks 200 were thicker lower arm 20, and cam 21, would be immobilized earlier in the stroke of handle 30. Clutch 50 would then release with handle 30 in a higher position than that shown in FIG. 2. In any case the release of clutch 50 represents the end of the first stage closing action. In FIG. 2, the position of handle 30 is slightly above the predetermined position of the start of the second stage clamping action. In the case of the larger blocks 200, handle 30 would need to rotate further to reach the start of the second stage since the first stage would end with a higher handle position. Rotation of handle 30 between the end of the first stage and the start of the second stage is called transitional travel. The start of the second stage is a fixed handle position while the end of the first stage depends on the size of the clamped object, and the related position of the handle. The amount of transitional travel will therefore depend on the object size. As an example, if the object were sized to span the maximum distance represented by the opening in FIG. 1, clutch 50 releases nearly instantly with no motion of lower arm 20. Handle 30 will then move from the uppermost position of FIG. 1 to a lower position just past that of FIG. 2. During this transition, no apparent action occurs on the arms of the clamp.

However during the transition, transition edge 55 of the clutch, FIG. 3, presses wall 37 of handle 30 at all times that the clutch is disengaged. The geometry of this interaction is such that clutch 50 is always biased to return to the engaged state of FIG. 1 by sliding of edge 55 down along wall 37. This transition bias serves two functions: to reset the clutch for another cycle, and to maintain lower arm 20 in position against the under side of blocks 200 during the transition travel of the handle through continued pressure between distal end 51 and cam 21. Optionally one or both surfaces of edge 55 and wall 37 may directionally serrated to increase the sliding resistance between the surfaces. This increase would add more force to hold lower arm 20 in its up position against blocks 200.

Figure 8:
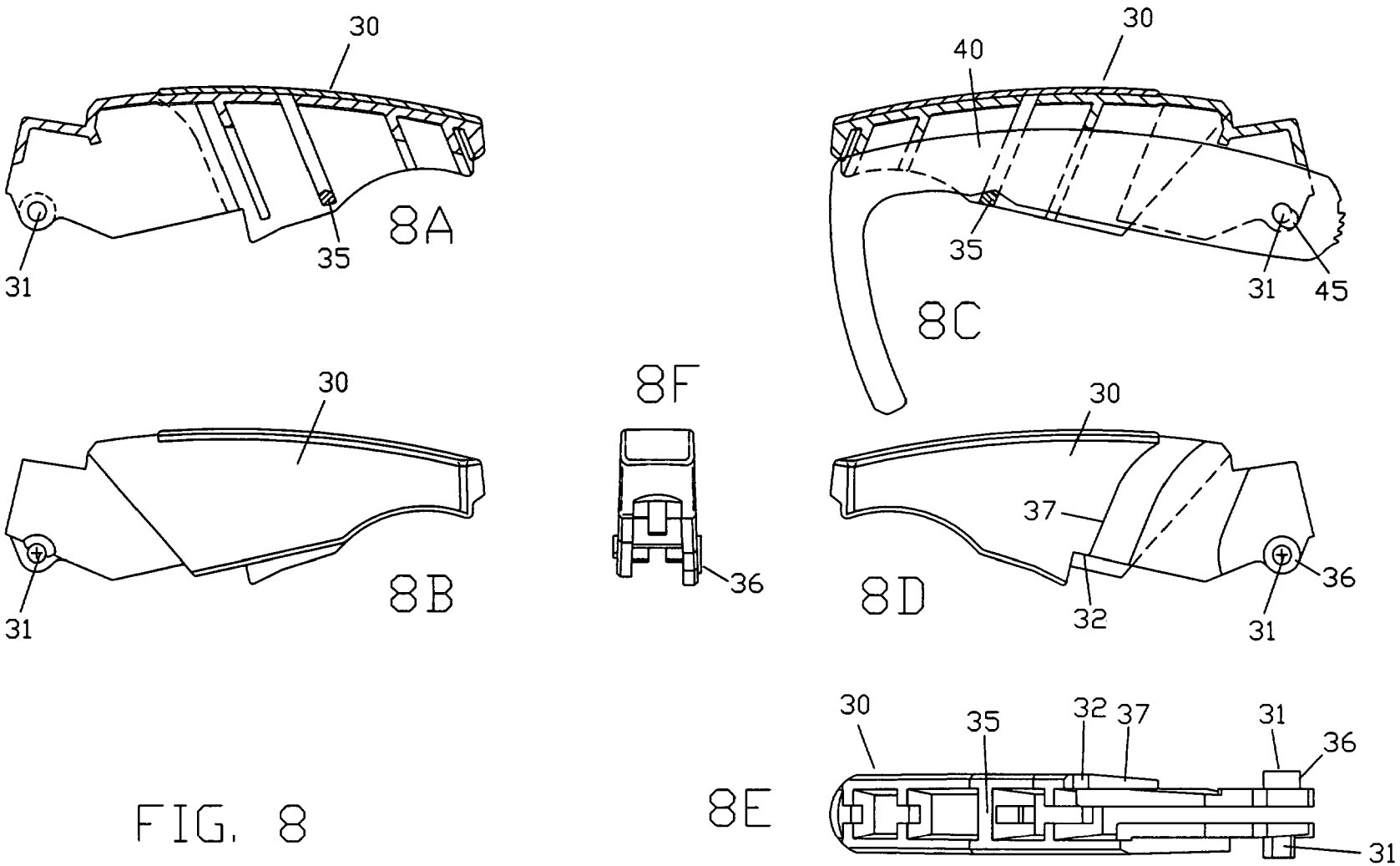
FIGS. 8A to 8F are views of a handle.
Figure 9B:
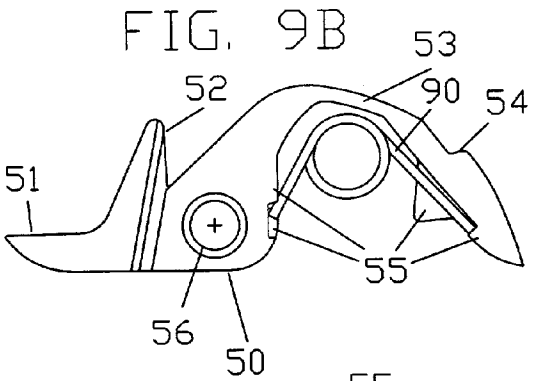
FIGS. 9A to 9C are views of a clutch.
Figure 9C:
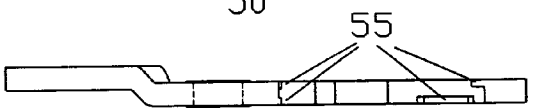
Figure 9A:
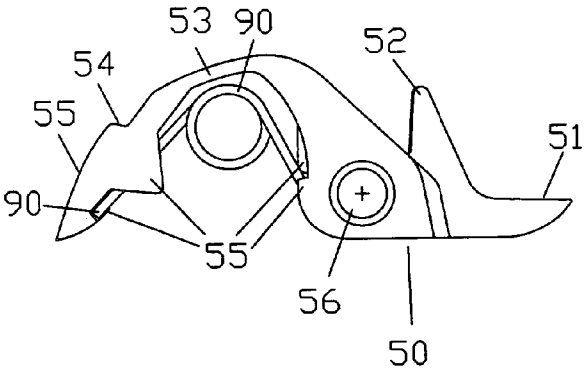
Figures 12, 13, 14:
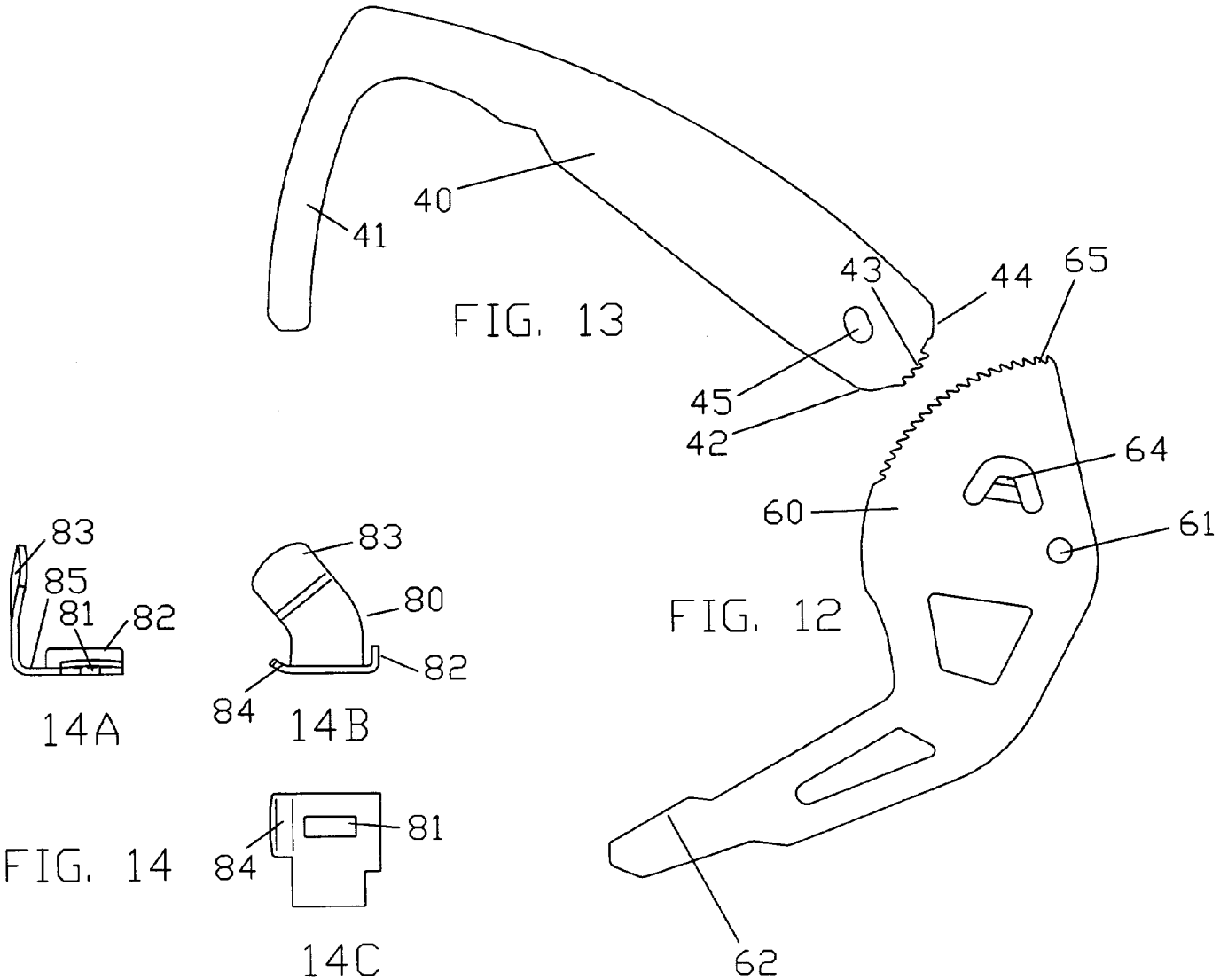
FIG. 12 is a side elevation of a gear.
FIG. 13 is a side elevation of a lever.

At a handle position just below that shown in FIG. 2, the second stage clamping action begins. The second stage comprises an interaction between lever 40, FIG. 13, and gear 60, FIG. 12. At the lower end of lever 40 is a set of teeth 43. Gear 60 has corresponding teeth 65. In FIGS. 1 to 3 clutch 50 is cut away to show these teeth. Lever 40 is fitted within handle 30. Lever 40 can slide slightly within handle 30 by motion of the lever about dowel 111 in slot 45. Slot 45 is best seen in FIG. 8C, and as a hidden line in FIGS. 1 to 3. Hole 31 of handle 30 contains dowel 111. Cross rib 35 holds lever 40 from moving down in handle 30, FIG. 8C. The handle is therefore rotatably fixed within upper arm 10. However slot 45 enables the lever to translate front to back within the handle. In FIGS. 1 and 2, the start and end of stage 1 closing, the respective teeth 43 and 65 are separated and do not interact. In FIG. 1 slot 45 can be seen extending up from dowel 111. This means that lever 40 is moved up and away from gear 60. In FIG. 2 dowel 111 is in an intermediate position within slot 45. Lever 40 is moving toward gear 60. The lever translation is controlled by sliding contact between cam 42 of the lever and ramp 12 of the upper arm. In FIG. 1 cam 42 and ramp 12 are holding the lever up. In FIG. 2 cam 42 has moved to a lower position against ramp 12. Lever teeth 43 are prepared to engage gear teeth 65 in FIG. 2. A gap is visible under cam 42 indicating that lever 40 is loosely confined in its sliding motion in FIG. 2. Cross rib 35, FIG. 8, holds lever 40 from falling out of handle 30, but is located to enable assembly of the lever into the handle.

Figure 11:
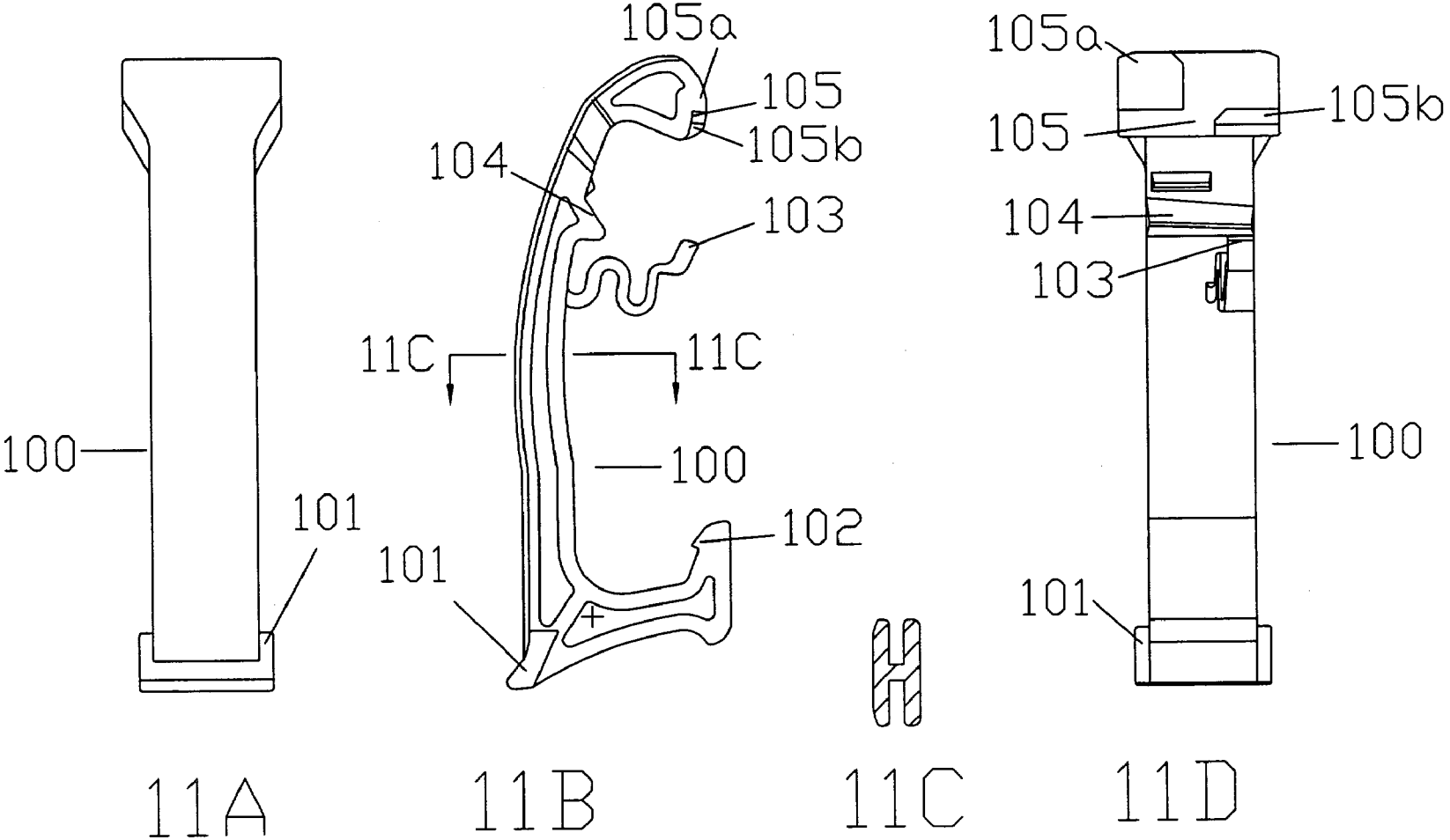
FIGS. 11A to 11D are views of a front guide.

To ensure that the lever is urged to engage gear 60, frontguide 100 presses stem 41 of lever 40 for all handle positions below that of FIG. 2, this being during the stage 2 clamping motion. Frontguide 100 is resilient so that as stem 41 slides past, see also FIG. 11, face 105 pushes the lever rearward as the frontguide flexes forward to accommodate stem 41. Frontguide 100 is fixed at its lower end at tabs 101 and catch 102. Tabs 101 fit into notches 17 of upper arm 10, FIG. 6. Catch 102 snaps over rib 13 of the upper arm during a one-time assembly operation. The vertical part of frontguide 100 is free to flex forward about the anchor defined by tab 101 and catch 102.

Optional smooth edge 44 of lever 40 is a synchronizing feature that helps ensure that lever teeth 43 and gear teeth 65 do not engage on their respective points as the lever moves downward and frontguide 100 pushes the lever into gear 60. A further synchronizing feature is shown at stops 22 of lower arm 20, FIGS. 1 and 2, as a gap between extension 62 of gear 60 and stops 22. Gear 60 preferably includes the lever like extension 62 to transmit torque created by lever 40 during second stage clamping to the body of lower arm 20. As the lever teeth engage the gear at the start of second stage clamping, gear 60 rotates slightly about hole 26 and dowel 110 within lower arm 20. In FIG. 3 gear 60 has rotated and the gap at 22 is gone. The process of closing this gap produces a gentle rolling motion between lever teeth 43 and gear teeth 65. This provides an opportunity for the teeth to mesh before high force is applied to the teeth. Optionally smooth edge 44 could be eliminated so that teeth 43 would clear gear teeth 65 just by rotating the handle upward. Slot 45 could also be a simple hole, with no translation of the lever needed to clear gear teeth 65.

In FIG. 3 the clamp is fully closed and pressed about blocks 200. Lever teeth 43 are fully engaged into gear teeth 65. The handle/lever assembly has been moved as far as it can go down toward upper arm 10. It can be seen that further travel of the lever into the upper arm is possible if gear 60 and associated lower arm 20 were free to rotate further upward. However the obstruction of blocks 200 prevents further travel. The particular stopping point of the lever depends on two items: how closely the arms were positioned about blocks 200 during the first stage closing, and upon the precise position of gear teeth 65 as determined by the thickness of blocks 200. The first item, positioning, is affected by the strength of clutch 50 engagement and transition bias discussed above (wall 37 and edge 55), as well as how the operator holds blocks 200 or other objects. In a worst case if the clamp is positioned too loosely in closing, then more of second stage clamping motion is needed to move the lower arm into position. Since second stage clamping produces high force but relatively little arm motion, it is possible that lever 40 will move down to its limit within upper arm 10 while blocks 200 are still not adequately pressed together. It is then necessary to open the clamp again to get the arms closer in first stage closing. It has been found in practice that adequate clamping is most often achieved before the lever bottoms out. The second item, which tooth 65 of gear 60 is first caught by lever teeth 43, especially determines how far down the lever will ultimately move. In FIG. 2 it can be seen that gear tooth 65A is going to be caught first by lever teeth 43, the lever teeth having just missed the adjacent tooth below 65A. However if blocks 200 were slightly thinner, the next down tooth would in fact be caught first since the gear teeth 65 would all be higher when first stage closing is done as in FIG. 2.

In FIG. 2 frontguide 100 presses stem 41 rearward, and thus teeth 43 into gear teeth 65. However there will be some wasted motion, as the first or top tooth 43 must move up substantially to meet and press gear tooth 65A. Therefore lever 40 will have moved down relatively far by the time blocks 200 are well pressed together. The final clamping position is in FIG. 3. In contrast if the gears had meshed immediately in FIG. 2 the final position shown in FIG. 3 would have the lever/handle assembly higher since there would be no take up of gear lash. The Figures show a best case with respect to how well the arms are pre-positioned (first stage) about the blocks. In reality there would be some additional closing motion needed in the second stage to abut the blocks before clamping, so the respective position in FIG. 3 would have the lever/handle lower. In fact much of the motion available in second stage clamping, represented by the length of stem 41, is to provide for final arm closing and gear meshing. Only a small motion is needed to actually squeeze blocks 200. A finer resolution of the gear teeth will minimize the worst-case motion needed for gear meshing. However the tooth size must be adequate for strength.

While a user will press handle 30 to squeeze blocks 200, there must be a way to hold the clamp after the user is done squeezing. This is a key function of stem 41. Release 80, FIGS. 1–3, 3A, and 14, wedges about stem 41 for any position of stem 41 within slot 81 of release 80. Release 80 pivots within slot 14 of arm 10, FIG. 3A. Slot 14 is seen alone in FIGS. 6A, and 6D. Upward force upon stem 41 causes release 80 to press upward in slot 14, at surface 85 of release 80. Such pressing produces a bending moment on release 80 relative to stem 41. This causes release 80 to grab stem 41 thereby holding lever 40 in a down position. Stem 41 could optionally use a toothed ratchet action. However a stepless action as shown is desirable to reduce any kickback of lever 40. Any upward free-play in lever 40 would cause the arms to back off of blocks 200, wasting available clamping force. Tabs 105*a* and 105*b* of face 105, FIG. 11D, keep stem 41 centered about slot 81 as the stem enters the slot.

Figure 3A:
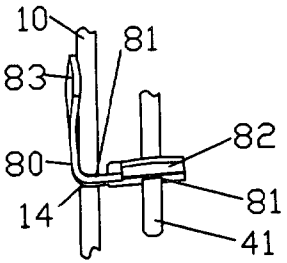
FIG. 3A is a detail view of a lever holding mechanism.
Figure 23:
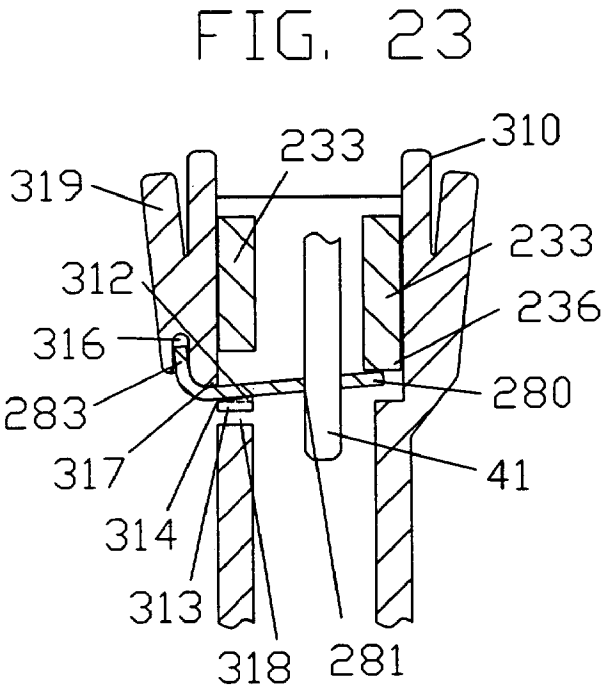
FIG. 23 is a view partly in section of an upper arm assembly in the area of the release member.
Figure 22B:
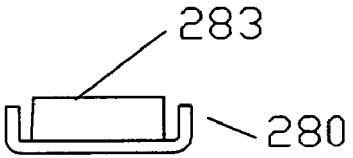
FIGS. 22A to 22C are views of an alternate embodiment release member.
Figure 22C:
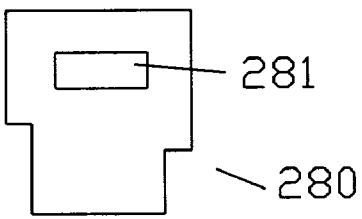
Figure 22A:
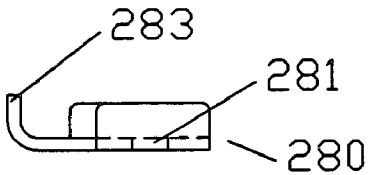

In the illustrated embodiment release 80 binds about rectangular sectioned, or other elongated sectioned such as ovoid, stem 41 by pressing the wide side surface of stem 41. The stem thus includes a narrow thickness and a larger width. The wide side surface or width of stem 41 is shown in all drawings of the stem other than FIGS. 3A and 23, where the thickness is shown. The release element or "binding wedge" pivots about a location facing the wide surface (slot 14 or 214) as best seen in FIGS. 3A and 23. This contrasts with the typical prior art stepless binding methods, such as in a quick action bar clamp. In such prior art designs a stem or bar of elongated sectional shape fits through a corresponding shaped slot in a wedge element. The wedge binds the bar at the thin edges of the bar, the wedge pivoting about a point facing the thin surface of the bar. The thin edges may be straight or arcuate in the case of an ovoid sectional bar. Thus the extent of the binding surface is defined by the thickness of the bar in the prior art designs. In the present invention the binding surface is much greater since it is upon the width or wide side surface of the bar, and normally includes the entire width. A larger binding surface prevents damage to the wedge or bar that may occur from high stresses if a high force were applied by binding just the thin edge of the bar. Therefore a compact wedge element can provide a high binding force by binding upon a much larger surface in the present invention. This improved binding method could be applied to any mechanism that uses a stepless binding system, such as bar clamps, caulking guns, jacks, etc.

To open the clamp a user presses release 80 at tab 83, to the right in FIG. 3A. This causes release 80 to rotate within slot 14, clockwise in FIG. 3A, breaking the hold of stem 41. The lever/handle assembly moves upward from the configuration of FIG. 3 toward that of FIG. 1. As the clamp opens stem 41 moves up past face 105 of frontguide 100. Lever 40 is then free to move out of engagement with teeth 65 of gear 60. Cam 42 presses ramp 12, ensuring that the respective teeth remain out of engagement. The clutch reset discussed above, using edge 55 and wall 37, causes clutch 50 to revert to the state of FIG. 1. Handle 30 at the same time reverts to its linkage to lower arm 20 by way of clutch distal end 51 and cam 21. A further element of the opening process is return spring 190, FIG. 4. Torsion spring 190 presses down upon arm 10 at support 191. Dowel 111 forms a central mandrel for the spring. At the rear spring 190 presses down upon tab 64 of gear 60. Tab 64 extends out of the page in FIG. 4, into the page in the opposite view FIG. 12. Spring 190 thus creates a bias to move lower arm 20 away from upper arm 10, through the linkage of gear 60. A secondary bias occurs against gear 60 relative to lower arm 20. By pressing at tab 64 rather than directly on lower arm 20, spring 190 urges extension 62 of gear 60 away from stops 22 in lower arm 20. As discussed earlier the resulting gap provides an opportunity for gear 60 to rotate slightly and for the respective gear teeth to mesh before high force is applied to the teeth. Spring 190 holds this gap open until the start of second stage clamping forces gear 60 to pivot slightly within lower arm 20.

Frontguide 100 includes elements that interact with release 80. Resilient arm 103 provides a bias to hold release 80 at an angle to ensure that release 80 binds upon stem 41. Release 80 pivots in slot 14 about surface 85, FIG. 3A. To free stem 41 a user presses tab 83 toward surface 19 of upper arm 10. Tab 83 is spaced from surface 19, FIGS. 3A, 4 and 6. The lower portion of release 80 moves downward as tab 83 is pressed. This lower portion includes angled tab 84 that slides along ramp 104 of frontguide 100. As tab 84 moves down, it forces the frontguide to deflect forward, to the left in FIGS. 1 to 3. Surface 105 then moves away from, or at least presses more weakly upon, the front edge of stem 41. The action of tab 84 causes a net rearward force upon release 80. To hold release 80 in position rear wall 82, FIG. 14B, slides against rib 16 of upper arm 10.

In FIGS. 18 to 23 an alternate embodiment release and frontguide design are shown. In this design the frontguide presses the release member directly in the release action. This contrasts with the above embodiment of FIGS. 11 and 14 where the release member presses the frontguide. An advantage of the present alternate embodiment is that the frontguide is directly urged to clear stem 41 of lever 40 to enable the lever to rotate upward freely.

Figure 19:
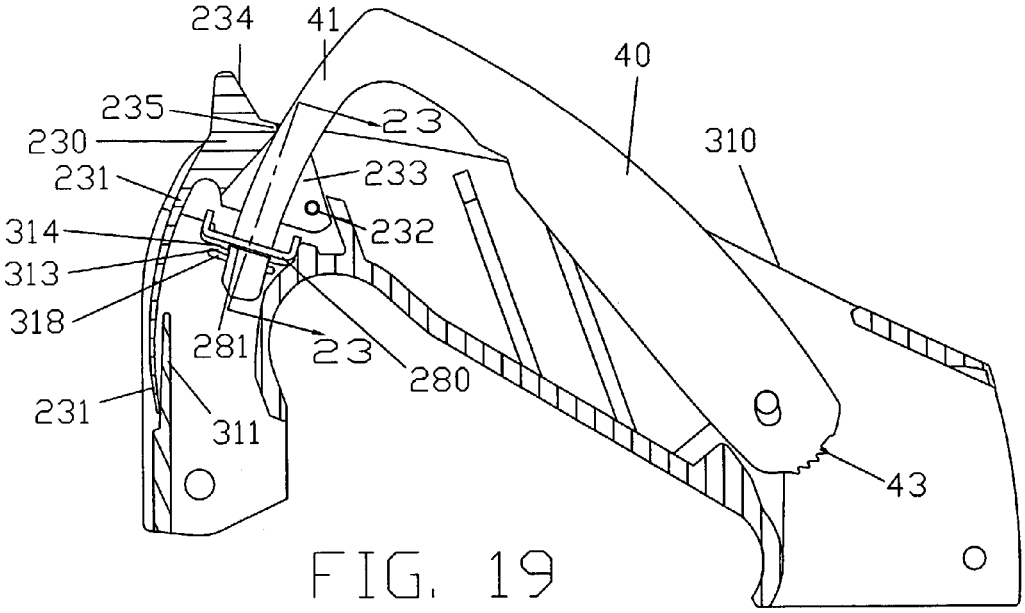
FIG. 19 is the upper arm of FIG. 18, the arm and a frontguide viewed partly in section from an opposite side from FIG. 18, including a release member in a locked condition.

In FIG. 19 the elements of the alternate embodiment are all shown. Lever 40 is held in slot 281, FIG. 22C, of release member 280. In the locked condition of stem 41, release member 280 is angled, FIG. 23. Frontguide 230 pivots about point 232 and is biased clockwise in FIG. 19 by resilient extension 231 pressing rib 311 of upper arm 310. The clockwise bias of the frontguide causes corner 235 to press stem 41 rearward. Teeth 43 are thus urged to engage further gear teeth, not shown, of gear 60, FIG. 12, according to the mechanism described for FIGS. 1 to 3. Arms 233 of frontguide 230 straddle stem 41. Points 232 of arms 233 may comprise outward extensions, not shown, that engage corresponding holes in upper arm 310. Frontguide 230 can be assembled into upper arm 310 by forcibly sliding the frontguide into the opening of upper arm 310, FIG. 23. The outward extensions of the frontguide will snap into the corresponding holes of the upper arm through spreading action from the resilience of extended arms 233.

Figure 18:
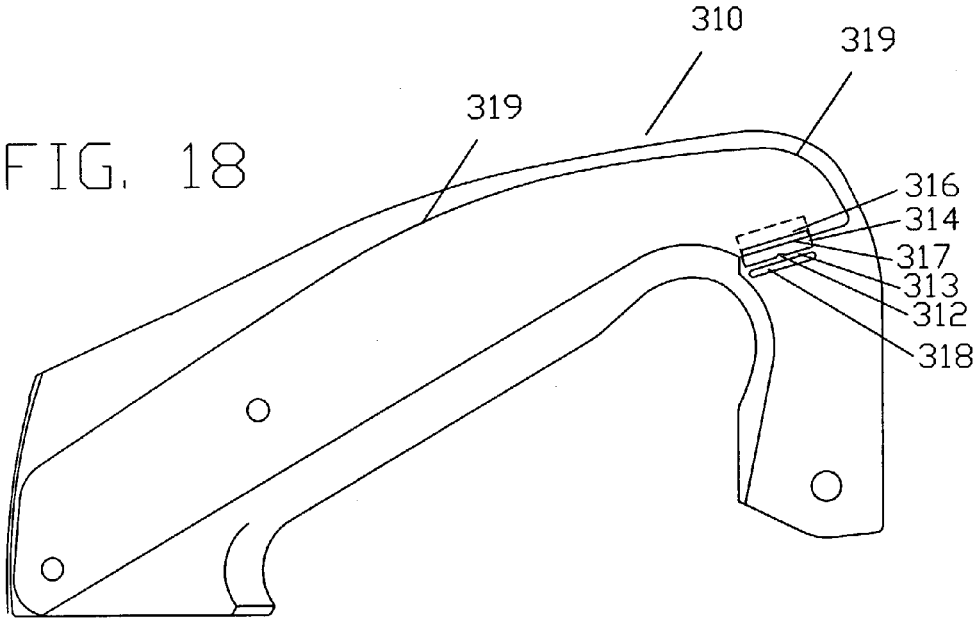
FIG. 18 is a side elevation view of an upper arm according to an alternate embodiment of the invention.

Release member 280 pivots about edge 317 within upper arm 310, FIG. 23. Tab 283 extends into slot 316, holding release member 280 in position laterally. Release member 280 must be biased upward, or counterclockwise in FIG. 23, to hold release 280 at an angle to ensure that release 280 binds upon stem 41. A member similar to resilient arm 103 described above may provide the bias. Or as illustrated in FIGS. 19 to 23, an alternate embodiment may be used. The resilient bias member here is rib 313, FIGS. 18 and 23. Gap 318 creates rib 313. More convoluted shapes for rib 313 could provide greater resiliency. Bump 312 of rib 313 presses under release member 280. As stem 41 binds in slot 281, release member 280 rotates downward to enable the stem to fit, causing rib 313 to deflect. The horizontal distance between edge 317 and bump 312 of rib 313 defines a torsion arm that gently rotationally biases the release member. Alternately a resilient material such as rubber could be fitted to upper arm 310 in the regions of rib 313 and gap 318 to serve the same biasing function upon release member 280. In FIGS. 18 and 23, stiffening rib 319 adds strength and a place to fit slot 316. Release member 280 fits within opening 314, FIGS. 18 and 23; FIG. 18 shows only upper arm 310, without further components.

Figure 21:
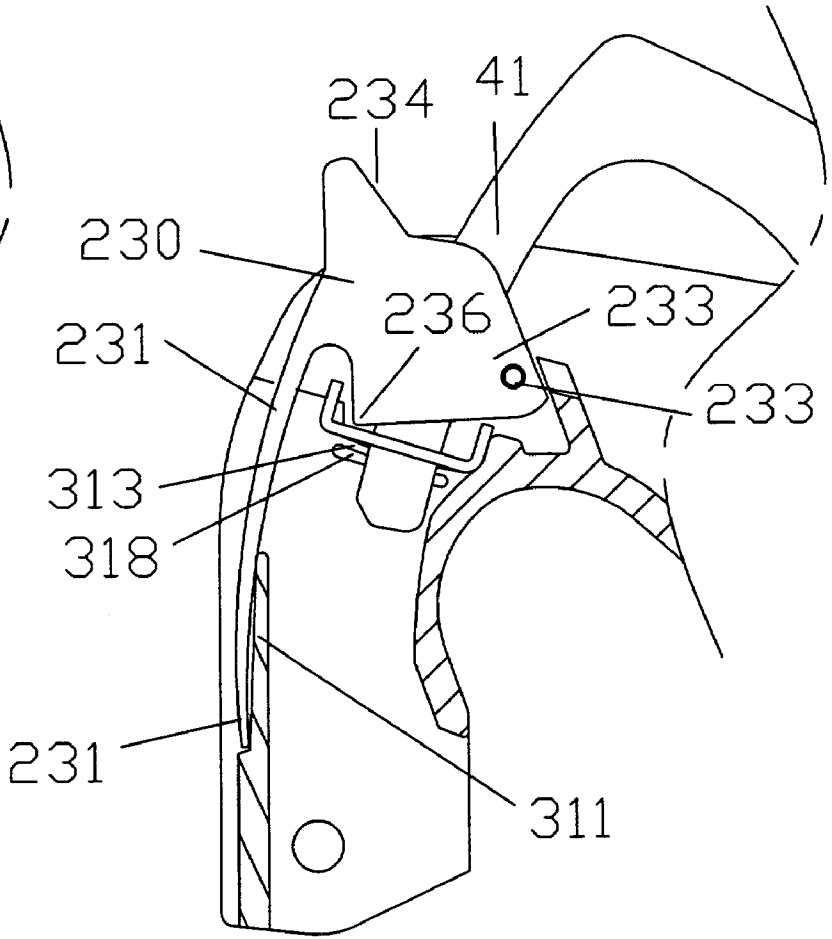
FIG. 21 is the detail view of FIG. 20, with the frontguide viewed in side elevation.
Figure 20:
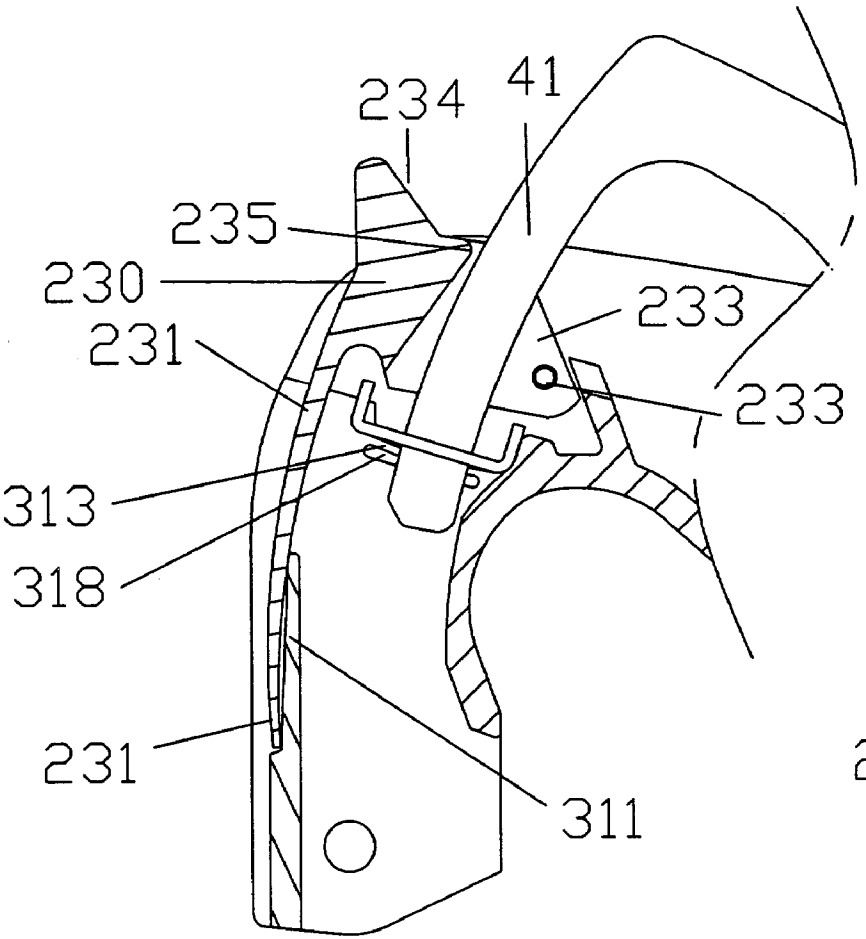
FIG. 20 is a detail view of the arm of FIG. 19, with the release member in an unlocked condition.

In FIG. 19 the assembly is in the locked condition with stem 41 bound in slot 281. In FIGS. 20 and 21, the assembly is in the released condition. In FIG. 21, corner 236 is pressing release member 280 down so that the release member is not angled in contrast with FIG. 19. Corner 236 is cut away in the section view of the frontguide in FIG. 20. Frontguide 230 is urged counterclockwise by pressing tab 234 forward. The lower distal end of resilient extension 231 slides along rib 311 as frontguide 230 moves forward. It can be seen that extension 231 has moved downward by comparing FIG. 19 to FIG. 20, at the distal end of extension 231, while extension 231 has also straightened in FIG. 20. It can be further seen that corner 235 is spaced from stem 41 in FIG. 20. Thus in FIGS. 20 and 21, stem 41 is free to move upward. In FIG. 23 corner 236 is just pressing release member 280 so that release member 280 begins to rotate and slot 281 begins to unbind stem 41.

Figure 10B:
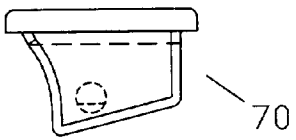
FIG. 10B is a side elevation of gripping pad.
Figure 10A:
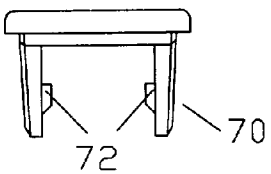
FIG. 10A is an end view of a gripping pad.

Returning to FIGS. 1 to 17, to accommodate different opening positions of the clamp, pads 70 may pivot about respective holes 18 and 24 of the upper and lower arms. Pads 70 are fitted with posts 72, FIG. 10A, to engage the holes.

Based on tests of a working model the presence of two distinct stages is not obvious to users as the clamp closes. Rather the single stroke closing and clamping action feels just like a single stroke. Therefore the present invention feels uncomplicated in use.

It is not required that lever 40 and handle 30 rotate together for all positions. Cross rib 35 of the handle could be deleted to allow them to rotate separately. For example as the clamp opens, lever 40 may rise just high enough to disengage lever teeth 43 from gear teeth 65. A tab, on the end of stem 41 for example, could limit the upward travel of the lever. This would be near the lever position of FIG. 2. Handle 30 would continue to rise up to the position of FIG. 1 to fully open the clamp. This design may be selected if it is desired to more clearly identify the two stages as the handle closes. In the first stage only the handle moves. In the second stage the handle and lever move together.

Alternate constructions may be anticipated where the assembly of handle 30 and lever 40 extends toward lower arm 20 and is pulled upward for an actuation stroke. The handle/lever assembly may be refered to generically as a lever.

Figure 15:
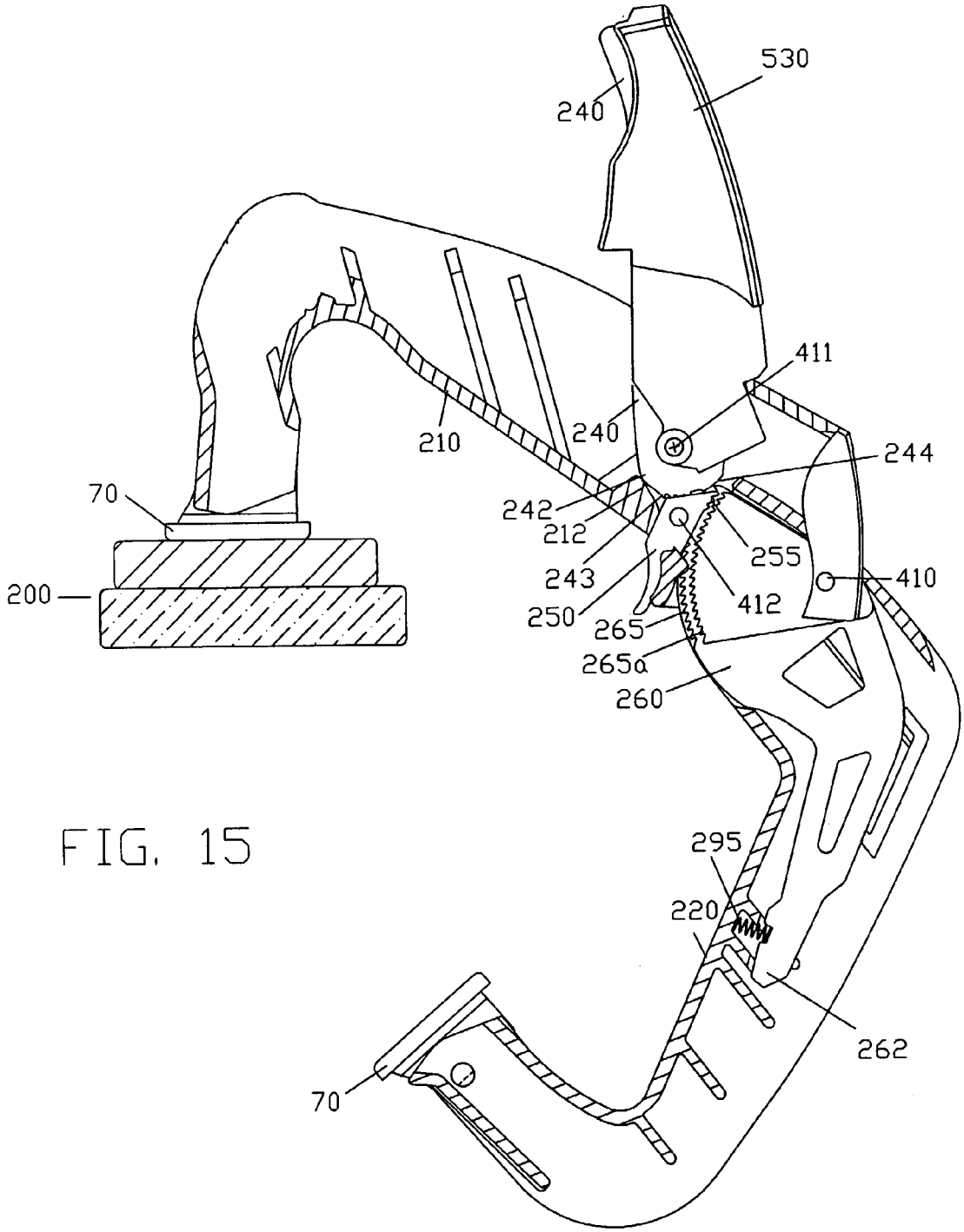
FIG. 15 is a side elevation, partly in section, of a release position of an alternate embodiment ratcheting clamp.
Figure 16:
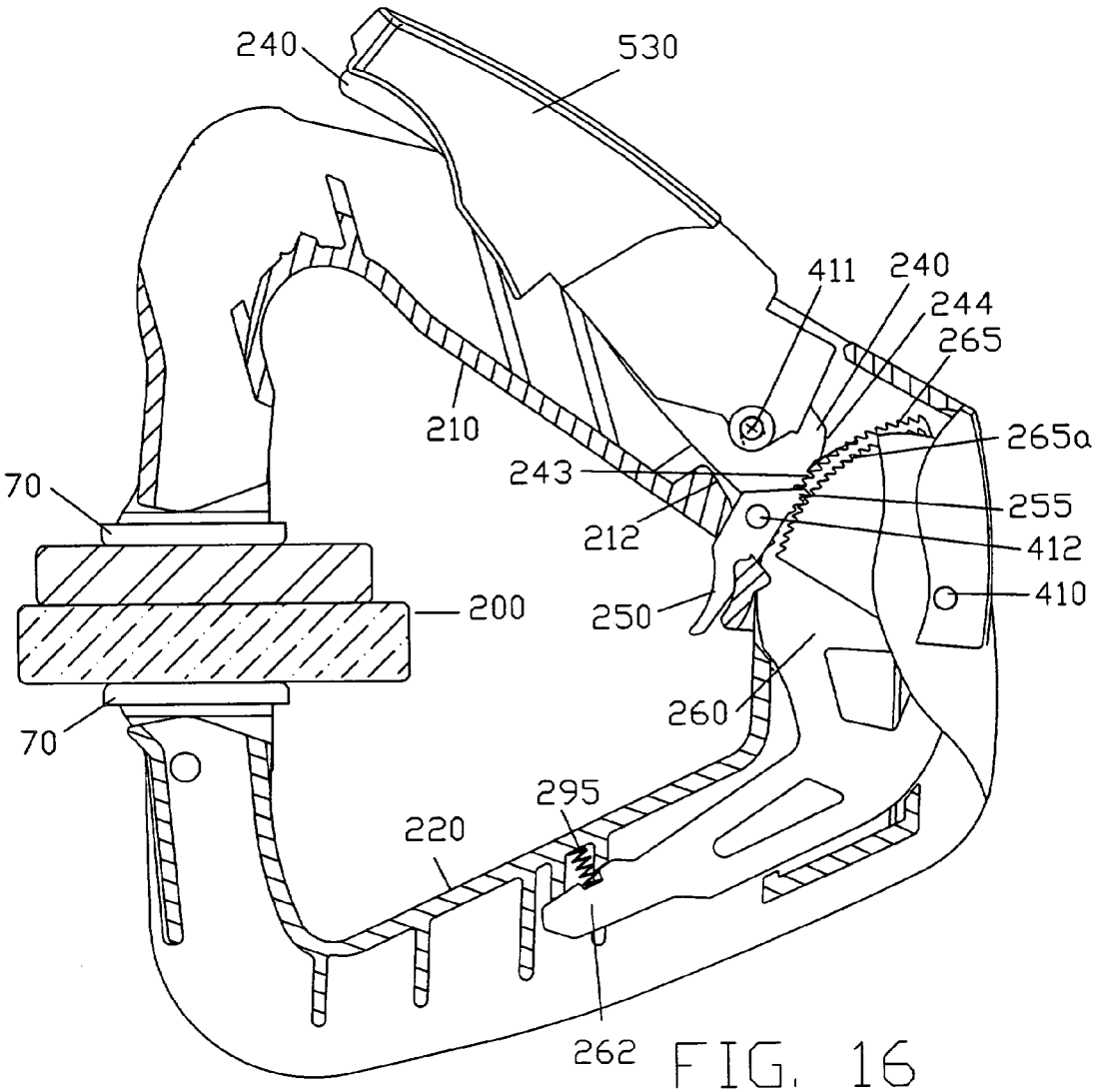
FIG. 16 is the clamp of FIG. 15, at the end of a final ratcheting stroke.
Figure 17:
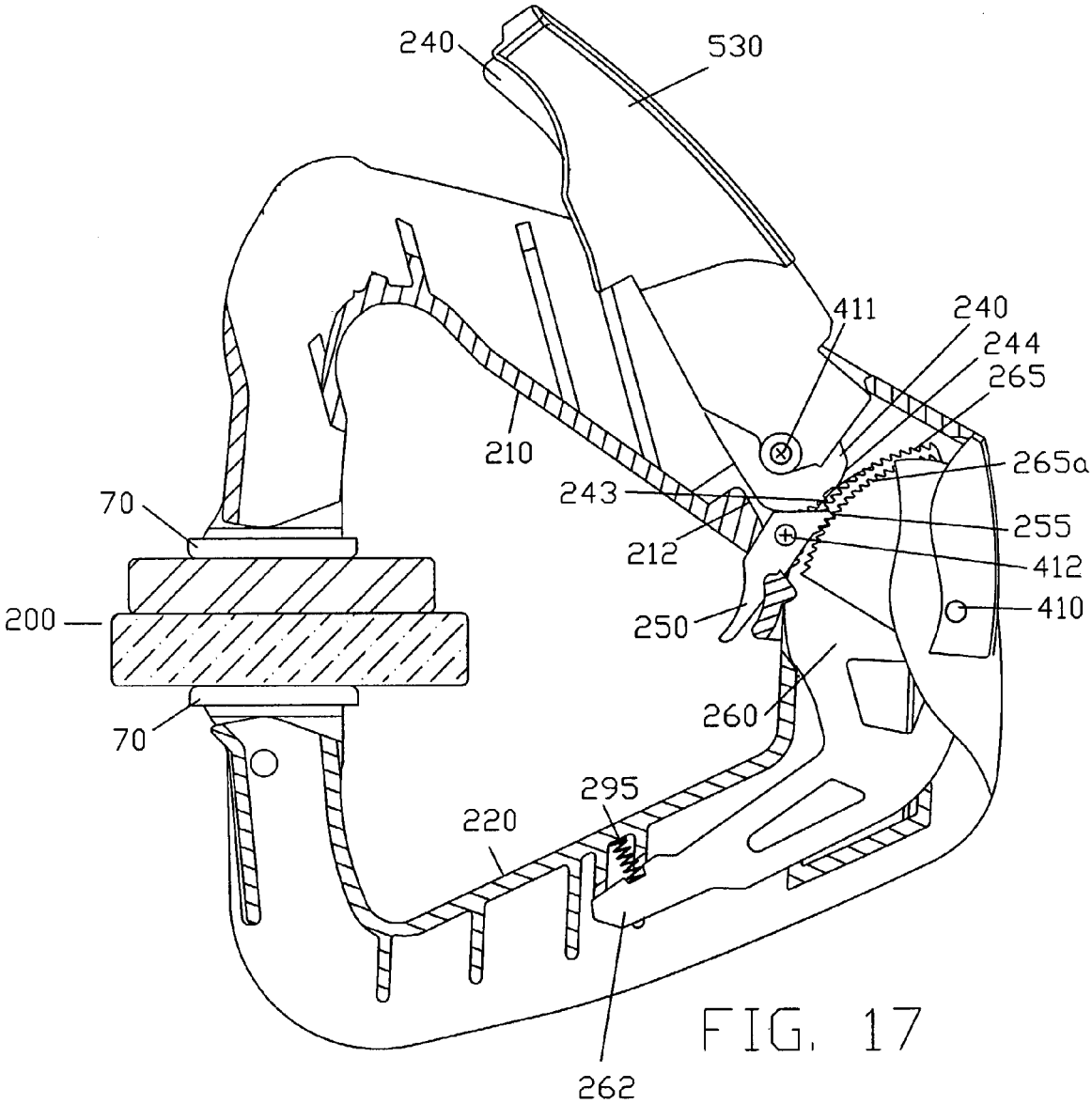
FIG. 17 is the clamp of FIG. 16, with the handle in its upper ratcheting position.

FIGS. 15 to 17 show an alternate embodiment of the present invention. The arms close by means of a ratcheting action upon the handle. The handle is repeatedly pressed down and allowed to return to an upper ratcheting position. A maximum height of the handle corresponds to a release position of the handle. The components of the single stroke two stage design described above may be adapted to the ratcheting embodiment of the clamp, with some modifications.

In FIG. 15 the release position is shown. Upper arm 210 pivots about pin 410 in relation to lower arm 220. Pads 70 press blocks 200 during clamping. Handle 530 rotates about pin 411, where pin 411 is further fitted in respective holes, not shown, in upper arm 210. Lever 240 is held within handle 530. Lever 240 rotates along with the handle about pin 411, and includes an elongated lever slot to fit around pin 411 such that lever 240 may translate slightly longitudinally relative to handle 530. This allows teeth 243 to align or synchronize with gear teeth 265 as handle 530 is lowered from the position of FIG. 15 to that of FIG. 17, where the ratcheting process starts. Smooth edge 244 of lever 240 holds the lever away from the gear teeth until a suitable position is reached wherein the respective teeth are aligned as the handle moves down. This synchronizing function is similar to that for the single stroke version of the invention described above. To move lever 240 away from gear 260 in the release position, cam 242 of lever 240 slides up ramp 212 to cause the lever to move away from the respective teeth 265 of gear 260.

In the exemplary embodiment a second set of coaxial gear teeth 265*a* are fixed to gear 265. These gear teeth define a smaller radius than that of teeth 265 in the Figures. They may define an equal or larger radius if preferred. Teeth 265*a* engage teeth 255 of detent 250 to hold the clamp in position after an advancing stroke has been completed. Detent 250 is spring biased, not shown, to engage the respective teeth 265*a* and 255. Detent 250 pivots about pin 412, with the pin supported in upper arm 210. Alternately, instead of coaxial gear teeth 265*a*, the arc formed by teeth 265 could extend further downward or rearward along gear 260, and detent 250 be positioned respectively below or above the engagement zone of teeth 243. Further the positions of detent 250 and gear teeth 265*a* could be reversed whereby a detent may be rotatably fixed to the lower arm and an arcuate set of teeth for the detent to engage fitted to the upper arm.

The lower end of detent 250 is a detent trigger that serves to disengage the detent from gear 260. In FIG. 15 detent trigger 250 has been depressed rearward so that a space is visible at detent teeth 255. This has allowed lower arm 220 to open to the position shown. Preferably the handle rises to the uppermost position in FIG. 15 only when the trigger of detent 250 is pressed. This occurs through a tab or other linkage, not shown, between detent 250 and lever 240 or handle 530. If the trigger is not pressed then the handle does not rise past the position of FIG. 17 when the handle is released.

A closing stroke is represented in FIGS. 16 and 17. The handle is repeatedly pressed and released to close lower arm 220 in increments toward the obstruction of blocks 200 in a ratcheting process. FIG. 16 shows a lowermost handle position for the particular thickness of blocks 200, as may occur when the obstruction is reached and the arms can close no further. The resulting "last stroke" of the handle closely resembles the second stage stroke of the two stage closing embodiment above, with the difference that multiple strokes are used in the present ratcheting embodiment to close the arms rather than the fast action first stage of the two stage embodiment. The handle is able to go lower than in FIG. 16 if the obstruction of blocks 200 is not yet reached. When the handle is released between strokes it raises up to the position of FIG. 17, being stopped preferably by the aforementioned link to detent 250. Lever 240 has a light bias spring, not shown, to urge the lever toward gear 260. In the return stroke the respective backside angles of the lever teeth 243 and gear teeth 265 allow the lever to ride up the gear against the bias of the light spring, producing a characteristic ratcheting sound. When the handle is in the full up release position, and smooth edge 244 holds the lever away from the gear, there will be no tooth engagement.

Detent 250 will hold gear 260, or any other element that the detent engages, in a finite set of positions determined by the resolution of the respective teeth. In certain conditions the arms will separate slightly after the last stroke of the handle as detent 250 finds an engagable set of teeth 265*a* with which to seat. To retain a squeezing force upon blocks 200 as gear 260 rotates back slightly, counterclockwise in FIGS. 15 to 17, spring 295 may press extension 262 of gear 260. Spring 295 should maintain a bias through a rotation of gear 260 equivalent to one tooth of the gear. Then as the gear rotates back, a net squeezing force remains. In FIG. 16 the last stroke has been completed, and gear 260 is rotated to its maximum clockwise position in lower arm 220, so that the extension is contacting the stop ribs to each side of spring 295. Note slight spaces between detent teeth 255 and teeth 265*a* in FIG. 16. The detent has not seated in this position. In FIG. 17 the last return stroke is completed and gear 260 with teeth 265*a* rotate counterclockwise until teeth 255 are fully seated. It can be seen that extension 262 has moved downward in the lower arm. However spring 295 continues to force lower arm upward to squeeze blocks 200. Spring 295 may take a variety of forms and locations. For example it may be a flat spring or a conical spring washer. Spring 295 biases the gear in the same direction as spring 190, FIG. 4, of the two stage version. However spring 295 of the ratchet design is much more stiff than spring 190 of the two stage design since the respective functions are quite different. Spring 295 contributes directly to the squeezing action, while spring 190 provides a light synchronizing motion.

The embodiments of the two stage closing clamp and the ratcheting clamp include many similar elements and concepts in the illustrated embodiments. The leverage of a handle is used in an actuating stroke to squeeze two opposed arms about an object. One difference may be the method used to hold the arms in a squeezing state. The present embodiment two stage design holds the lower arm indirectly by grabbing and holding the lever, while the ratcheting design directly holds the lower arm by a detent. A second difference is the method for positioning the arms about an object. The two stage design uses a disengagable fast motion first stage to close the arms. The ratcheting version uses multiple ratcheting strokes to incrementally close the arms. In either version it is normally possible to use a second hand to position the arms about the object instead of first stage closing or multiple ratcheting strokes. However one feature of the present invention is that it may be used with only a single hand.

In the illustrated embodiments particular shapes for the various components are shown. Other shapes may be used depending on design choice. Also other locations or designs for certain components may be used. For example release 80 and stem 41 may be located elsewhere on upper arm 10, such as closer to dowel 111 or even behind dowel 111. In the ratcheting design detent 250 may be oriented or positioned elsewhere, such as with the trigger extending upward from pin 412. A detent similar to 250 may be substituted into the two stage design in place of release 80 and stem 41. In this option the lower arm is held more directly rather than through an element of lever 40.

In a further variation the clamp closing may be caused or assisted by action upon gear 60. A lever, cam or other interface could operate on extension 62 to force gear 60 to rotate, counterclockwise in the Figures, in relation to lower arm 20. If gear 60 is fixed relative to upper arm 10, the lower arm moves toward the upper arm. This leveraging could be instead of the second stage clamping. Or it could provide a supplement to second stage clamping to squeeze an object more tightly. Similar leveraging of gear 260 could supplement a final ratchet stroke of the ratcheting design of FIGS. 15 to 17, or directly provide the ratcheting stroke by pressing gear 260 against a detent within upper arm 210 as lower arm 220 moves toward upper arm 210.

What is claimed is:

1. A lever actuated clamp for the purpose of creating a squeezing force, the clamp including an open clamp position and a closed clamp position wherein:

two opposed elongated arms are hinged together at a rear hinge point, the hinge point being at respective arm rear hinge ends, the arms including an upper arm and a lower arm;

the upper arm having an upper jaw end, and the lower arm having a lower jaw end, the jaw ends being at distal front ends of the arms, the respective jaw ends substantially facing toward each other;

the lower arm being rotatable about the hinge point with respect to the upper arm such that the respective jaw ends can be moved toward each other to the closed clamp position and the respective jaw ends can also be moved apart toward the open clamp position, the closed clamp position being determined by a size of an object that is squeezed between the respective jaw ends;

a lever being pivotably attached to the upper arm at a lever pivot location of the upper arm the lever extending upward from the lever pivot location of the upper arm, the lever extending away from the upper arm, the lever being positioned substantially between the rear hinge point and the upper jaw end, the lever being linked to the lower arm at a lever lower end, the lever lower end being positioned between the lever pivot location and the rear hinge point, wherein a forced rotational motion of the lever with respect to the upper arm comprises an actuation stroke, the actuation stroke causing a front end of the lever to move toward the upper jaw end, the actuation stroke further causing a rotational bias toward the closed clamp position upon the lower arm about the hinge point.

2. The clamp of claim 1 wherein the rotational motion of the lever is toward the upper arm, and the lever extends from the upper arm away from the lower arm.

3. The clamp of claim 1 including a maximum open clamp position wherein the upper and lower jaw ends are separated to a greatest practical extent, and a minimum closed position wherein the upper and lower jaw ends are in direct contact, and a single actuation stroke of the lever enables the clamp to move from the maximum open position to the minimum closed position.

4. The clamp of claim 3 where the lever is linked to the lower arm through a two stage action wherein:

a first closing stage provides a relatively low leverage upon the lower arm by the lever with a corresponding relatively fast motion of the lower arm, the first stage having the jaw ends move to abut against the object to be squeezed, the first stage occurring through an initial range of motion of the lever;

a first stage link between the lever and the lower jaw being through a releasable clutch, the clutch releasing as the actuation stroke continues toward a second stage, while the arms can not close further toward each other as a result of an obstruction created by the object;

a second stage provides a high leverage upon the lower arm by the lever in relation to the upper arm, where the jaw ends are forced to squeeze the object, a second stage link between the lever and the lower jaw commencing during the actuation stroke at a predetermined position of the lever relative to the upper arm after first stage positions of the lever in the actuation stroke;

a releasable latch that holds the lever in a second stage lever position to maintain a force through the second stage link, and thereby maintain a squeezing force upon the object.

5. The clamp of claim 4 wherein a gear is fitted to the lower arm, the lever includes gear teeth at one end, and the second stage link comprises a releasable engagement of the lever gear teeth with the lower arm gear.

6. The clamp of claim 5 wherein the lever includes two distinct elements: a handle, and an inner lever slidably fitted within the handle, the inner lever being translatable in relation to the lever, the inner lever sliding toward the lower arm gear to engage the lever gear teeth with the lower arm gear.

7. The clamp of claim 1 including a maximum open clamp position wherein the upper and lower jaw ends are separated to a greatest practical extent, and a minimum closed position wherein the upper and lower jaw ends are in direct contact, and a series of actuation strokes of the lever enables the clamp to move in increments from the maximum open position to the minimum closed position.

8. The clamp of claim 7 wherein a gear is fitted to the lower arm, the lever includes gear teeth at one end, the lever gear teeth engage the lower arm gear during each actuation stroke causing the lower arm to close incrementally, a return stroke of the lever disengages the lever gear teeth from the lower arm gear in preparation for a further actuation stroke, and a releasable detent engages a gear fitted to the lower arm whereby the detent holds the clamp from opening during the lever return stroke.

9. The clamp of claim 8 wherein the lower arm gear is rotatable within the lower arm, and a stiff spring biases the gear in a direction opposite to that by which the lower arm closes toward the upper arm.

10. The clamp of claim 8 wherein the detent engages a gear that is distinct from the lower arm gear.

11. The clamp of claim 1 wherein a first arm is fitted with a gear, the gear including an arcuate array of teeth, the gear is fixed in relation to a second opposing arm, the gear is forced to rotate with respect to the first arm, the forced rotation of the gear urging the respective arms toward the closed clamp position.

12. A lever actuated clamp for the purpose of creating a squeezing force, the clamp including an open clamp position and a closed clamp position wherein:

two opposed elongated arms are hinged together at a rear hinge point, the hinge point being at respective arm rear hinge ends, the arms including an upper arm and a lower arm;

the upper arm having an upper jaw end, and the lower arm having a lower jaw end, the jaw ends being at distal front ends of the arms, the respective jaw ends substantially facing toward each other;

the lower arm being rotatable about the hinge point with respect to the upper arm such that the respective jaw ends can be moved toward each other to the closed clamp position and the respective jaw ends can also be moved apart toward the open clamp position, the closed clamp position being determined by a size of an object that is squeezed between the respective jaw ends;

a lever being pivotably attached to the upper arm and extending from the upper arm, the lever being positioned substantially between the rear hinge point and the upper jaw end, the lever being linked to the lower arm, wherein a forced rotational motion of the lever toward the upper arm comprises an actuation stroke, the actuation stroke causing a rotational bias upon the lower arm about the hinge point toward the closed clamp position;

the clamp including a maximum open clamp position wherein the upper and lower jaw ends are separated to a greatest practical extent, and a minimum closed position wherein the upper and lower jaw ends are in direct contact, and a single actuation stroke of the lever enables the clamp to move from the maximum open position to the minimum closed position;

the lever is linked to the lower arm through a two stage action including a first closing stage that provides a relatively low leverage upon the lower arm by the lever with a corresponding relatively fast motion of the lower arm, the first stage having the jaw ends move to abut against the object to be squeezed, the first stage occurring through an initial range of motion of the lever;

a first stage link between the lever and the lower jaw being through a releasable clutch, the clutch releasing as the actuation stroke continues toward a second stage, while the arms can not close further toward each other as a result of an obstruction created by the object;

a second stage provides a high leverage upon the lower arm by the lever in relation to the upper arm, where the jaw ends are forced to squeeze the object, a second stage link between the lever and the lower jaw commencing during the actuation stroke after the initial range of motion of the lever;

a releasable latch that holds the arms in the closed position, the latch comprising a linkage that maintains a squeezing force upon the object.

13. The clamp of claim 12 wherein a gear is fitted to the lower arm, the lever includes gear teeth at one end, and the second stage link comprises a releasable engagement of the lever gear teeth with the lower arm gear.

14. The clamp of claim 13 wherein the lever includes two distinct elements: a handle, and an inner lever slidably fitted within the handle, the inner lever being translatable in relation to the upper arm, the inner lever sliding toward the lower arm gear to engage the lever gear teeth with the lower arm gear.

15. The clamp of claim 12 wherein the releasable latch includes a slot, and the lever includes a stem, the latch binds the stem when the stem is within the slot and the clamp is in the closed position.

16. A lever actuated clamp for the purpose of creating a squeezing force, the clamp including an open clamp position and a closed clamp position wherein:

two opposed elongated arms are hinged together at a rear hinge point, the hinge point being at respective arm rear hinge ends, the arms including an upper arm and a lower arm;

the upper arm having an upper jaw end, and the lower arm having a lower jaw end, the jaw ends being at distal front ends of the arms, the respective jaw ends substantially facing toward each other;

the lower arm being rotatable about the hinge point with respect to the upper arm such that the respective jaw ends can be moved together to the closed clamp position and the respective jaw ends can also be moved apart toward the open clamp position, the closed clamp position being determined by a size of an object that is squeezed between the respective jaw ends;

a lever being pivotally attached to the upper arm and extending from the upper arm, the lever being positioned substantially between the rear hinge point and the upper jaw end, the lever being linked to the lower arm, wherein a forced rotational motion of the lever with respect to the upper arm comprises an actuation stroke, the actuation stroke causing a rotational bias upon the lower arm about the hinge point toward the closed clamp position;

the jaw ends are moved to be adjacent to the object to be squeezed, and an actuation stroke causes the object to be squeezed between the upper and the lower jaw ends;

a release element holds the arms in the closed position, the release element comprising a linkage between an arm of the clamp and the lever whereby the release element holds the lever fixed relative to the arm and causes a squeezing force to be maintained upon the object.

17. The clamp of claim 16 wherein the jaws ends are moved incrementally from the open position toward the object by a series of actuation strokes.

18. The clamp of claim 16 wherein the jaw ends are moved from the open position toward the object by directly urging the arms toward each other.

19. The clamp of claim 16 wherein the jaw ends are moved from the open position toward the object during the actuation stroke through a first stage linkage including a releasable clutch, the clutch linking the lever to the lower arm.

20. The clamp of claim 16 wherein the lever is pivotally attached to the upper arm forward of the rear hinge point.

21. A lever actuated clamp for the purpose of creating a squeezing force, the clamp including opposed arms, each arm including a jaw, the clamp having an open clamp position and a closed clamp position wherein:

a jaw of the clamp is linked to a lever whereby moving the lever causes the jaw to move toward a closed clamp position;

a binding wedge comprises a release member, the binding wedge is pivotably attached to an arm of the clamp;

a stem is linked to the lever, moves within a slot the binding wedge as the lever and the jaw of the clamp respectively move, the stem including an elongated section having a narrow thickness defined at a thin edge and a width defined at a wide side surface of the stem;

the binding wedge binds the stem at the wide side surface of the stem to prevent the jaw of the clamp from moving toward the open position of the clamp.

22. The clamp of claim 16 wherein:

the release element is movably attached to the upper arm, the release element holds the lever from moving in relation to the upper arm when the clamp is in the closed clamp position, the release element breaks hold of the lever when the release element is forced to move in a predetermined manner in relation to the upper arm.

23. The clamp of claim 22 wherein the release element includes a wedge, and a slot of the wedge binds about a stem of the lever, the stem being rectangular in section including a narrow thickness and a larger width, the slot of the wedge binds the stem by pressing the stem upon a surface of the width of the stem.

24. A lever actuated clamp for the purpose of creating a squeezing force, the clamp including opposed arms, each arm including a jaw, the clamp having an open clamp position and a closed clamp position wherein:

a jaw of the clamp is linked to a lever whereby moving the lever causes the jaw to move toward a closed clamp position;

a binding wedge comprises a release member, the binding wedge is pivotably attached to an arm of the clamp;

a stem is linked to the lever, the stem moves within a slot of the binding wedge as the lever and the jaw of the clamp respectively move, the stem including an elongated section having a narrow thickness defined at a thin edge and a width defined at a wide side surface of the stem;

the binding wedge pivots against the arm as the binding wedge binds the stem, a bending moment is produced on the binding wedge relative to the stem;

the binding wedge presses the stem at the wide side surface of the stem to prevent the jaw of the clamp from moving toward the open position of the clamp.

* * * * *